US006722849B1

(12) United States Patent
Lievens et al.

(10) Patent No.: US 6,722,849 B1
(45) Date of Patent: Apr. 20, 2004

(54) PROPELLER FOR TUBEAXIAL FAN

(75) Inventors: Ronald J. Lievens, Olathe, KS (US); Tung Kim Nguyen, Overland Park, KS (US); Wanlai Lin, Lenexa, KS (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/093,879

(22) Filed: Mar. 8, 2002

(51) Int. Cl.[7] ..... F01D 1/00

(52) U.S. Cl. ..... 415/220; 415/124.2; 415/192; 416/243

(58) Field of Search ..... 415/124.2, 220, 415/229, 192, 223 R, 223 A, 169 A; 416/243, DIG. 2, DIG. 5, 195

(56) References Cited

U.S. PATENT DOCUMENTS

| | | | | |
|---|---|---|---|---|
| 2,708,373 A | | 5/1955 | Werner | |
| 2,790,596 A | | 4/1957 | Stirling | |
| 3,924,965 A | | 12/1975 | Lievens et al. | |
| 3,969,805 A | | 7/1976 | Lievens et al. | |
| 4,008,007 A | | 2/1977 | Shipes | |
| 4,087,927 A | | 5/1978 | Basmajian | |
| 4,088,017 A | | 5/1978 | Olges | |
| 4,173,300 A | | 11/1979 | Sanko | |
| 4,352,635 A | | 10/1982 | Saunders | |
| 5,184,938 A | | 2/1993 | Harmsen | |
| 5,273,400 A | * | 12/1993 | Amr | 416/189 |
| 5,279,379 A | | 1/1994 | Sixsmith | |
| 5,513,951 A | * | 5/1996 | Komoda et al. | 415/119 |
| 5,769,607 A | * | 6/1998 | Neely et al. | 416/189 |
| 6,142,733 A | * | 11/2000 | Alizadeh et al. | 415/208.2 |
| 6,241,474 B1 | * | 6/2001 | Alizadeh et al. | 416/189 |
| 6,315,521 B1 | * | 11/2001 | Hunt | 416/192 |
| 6,368,061 B1 | * | 4/2002 | Capdevila | 416/169 A |
| 6,428,277 B1 | * | 8/2002 | Holmes | 416/192 |
| 6,457,953 B1 | * | 10/2002 | Bradbury et al. | 417/423.1 |

OTHER PUBLICATIONS

Declaration of Inventor, Tung Kim Nguyen, attesting to pre–critical and post–critical date activities.
Declaration of Henry H. Prevot attesting to pre–critical and post–critical date activities.
Copy of Notice of Allowance in co–pending Application No. 10/093,868 (with copy of claims pending therein).
Copy of Notice of Allowance in co–pending Application No. 10/093,869 (with copy of claims pending therein).

* cited by examiner

*Primary Examiner*—Edward K. Look
*Assistant Examiner*—J. M. McAleenan
(74) *Attorney, Agent, or Firm*—Hovey Williams LLP

(57) ABSTRACT

A tubeaxial fan (10) broadly including a cylinder (12), a propeller (14) rotatably supported in the cylinder (12), and a drive assembly (16) operable to rotate the propeller (14) is disclosed. The propeller (14) includes blades (28,30,32,34, 36,38) each having an inventive blade design. The inventive blade design presents a chord length (C), a stagger angle ($\beta_e$), and a camber height ($\delta_c$) that vary along each of the blades as shown in TABLE 1. The inventive blade design presents an external surface of each of the blades having a shape defined by the relative positioning of a plurality of coordinates contained in at least nine cross-sections (e.g., the blade (28) includes cross-sections (44,46,48,50,52,54, 56,58,60)). The cross-sections (44,46,48,50,52,54,56,58,60) of the illustrated blade (28) have the corresponding plurality of coordinates listed in TABLE 2. The drive assembly (16) incorporates an inventive design that presents, among other features, a cover dimension $D_C$ of the bearing cover (72) of less than about one-sixth the propeller diameter (δ), and tapering end sections (**76*a*,76*b*) on the belt cover (76). A preferred alternative embodiment is also disclosed in the fan (210) including support plates (212*a*,212*b*) having a plate width ($W_P$) between about one-tenth and one-seventh of the axial length of the cylinder (212**).

20 Claims, 6 Drawing Sheets

PROPELLER FOR TUBEAXIAL FAN

CROSS-REFERENCE TO RELATED APPLICATIONS

This application is related to contemporaneously filed applications Ser. No. 10/093,869, entitled "Tubeaxial Fan Assembly" and Ser. No. 10/093,868, entitled "Drive Support and Cover Assembly for Tubeaxial Fan" which are hereby incorporated by reference herein.

BACKGROUND OF THE INVENTION

1. Field of the Invention

The present invention relates generally to fans for moving air. More specifically, the present invention concerns a high performance tubeaxial fan that provides increased efficiency and reduced noise levels relative to prior art tubeaxial fans.

2. Discussion of Prior Art

Fans are used in a variety of household and industrial applications to force air into and/or out of certain environments. For example, many industrial settings utilize ventilation systems that incorporate one or more fans to provide clean air and/or to exhaust polluted air from various work locations. The optimum fan for a particular application will have certain performance criteria required by the application (e.g., flow volume requirements, pressure differentials, etc.).

Tubeaxial fans are known in the art and are particularly suited for applications requiring the movement of large amounts of air with only relatively small pressure differentials (e.g., spray booths, cleaning tanks, mixing rooms, etc.). However, these prior art tubeaxial fans, while effective, have several non-optimizing limitations. For example, prior art tubeaxial fans have a relatively high noise level during operation. High noise levels are undesirable because many applications where tubeaxial fans are utilized involve settings where humans live or work. Furthermore, prior art tubeaxial fans have a relatively low efficiency. Low efficiency is undesirable because many applications where tubeaxial fans are utilized involve extended periods of continuous or repeated fan use.

SUMMARY OF THE INVENTION

The present invention provides an improved tubeaxial fan that does not suffer from the limitations of the prior art tubeaxial fans as set forth above. The inventive fan provides a high performance tubeaxial fan that combines both reduced noise levels and improved efficiency relative to the prior art tubeaxial fans.

A first aspect of the present invention concerns a fan that broadly includes a central hub for rotation about a rotational axis, and a plurality of blades fixed relative to the hub to project radially therefrom. Each of the blades presents a root adjacent the hub and a tip spaced radially outward from the root. Each of the tips is spaced from the rotational axis a tip radius. Each of the blades presents a chord length that is smaller at the root and tip relative to a maximum chord length location spaced between the root and tip. The chord length presented by each of the blades progressively and gradually increases from the root to the maximum chord length location and progressively and gradually increases from the tip to the maximum chord length location. Each of the blades presents a stagger angle that is relatively greater at the tip than at the root. The stagger angle presented by each of the blades progressively and gradually increases from the root to the tip. Each of the blades presents a camber height that is smaller at the root and tip relative to a maximum camber height location spaced between the root and tip. The camber height presented by each of the blades progressively and gradually increases from the root to the maximum camber height location and progressively and gradually increases from the tip to the maximum camber height location.

A second aspect of the present invention concerns a fan that broadly includes a propeller housing, and a propeller rotatably supported in the housing for rotation about a rotational axis. The propeller includes a central hub and a plurality of blades fixed relative to the hub to project radially from the hub. Each of the blades includes an external surface having a shape defined by the relative positioning of a plurality of coordinates contained in at least nine cross-sections of the external surface. The plurality of coordinates is defined on a three-dimensional grid having its origin on the rotational axis and including an X axis extending radially from the origin, a Y axis coplanar with the X axis and extending from the origin orthogonally to the X axis, and a Z axis coextensive with the rotational axis. The plurality of coordinates comprises the coordinates listed in TABLE 2 herein.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 8:
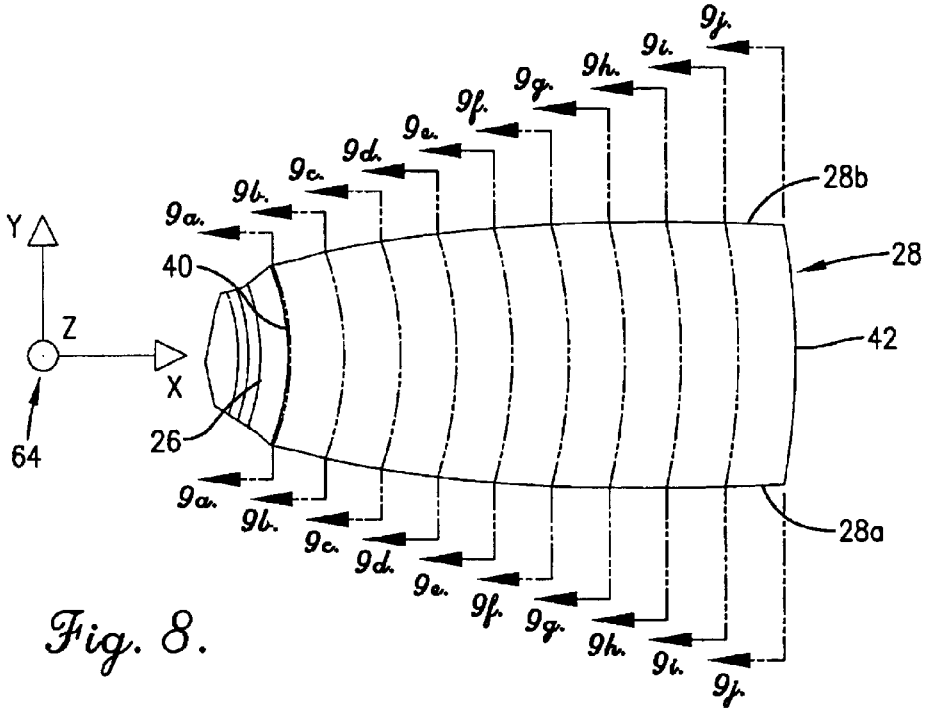
FIG. 8 is a partial plan view of the blade with the portion of the blade that couples to the hub shown in fragmentary.
Figure 9A:
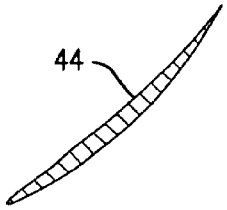
Figure 9B:
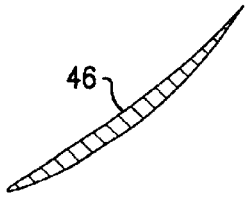
Figure 9C:
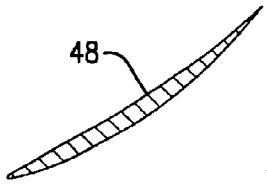
Figure 9D:
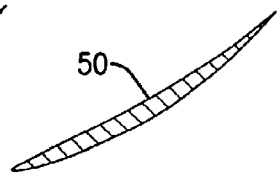
Figure 9E:
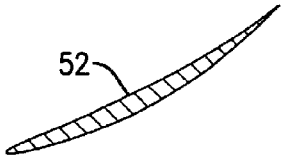
Figure 9F:
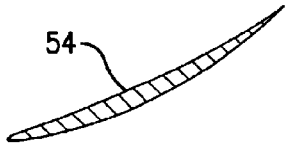
Figure 9G:
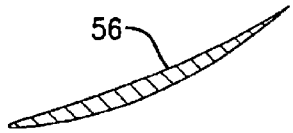
Figure 9H:
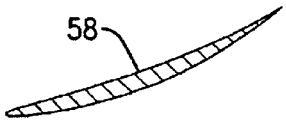
Figure 9I:
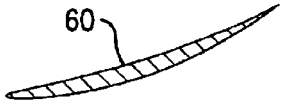
Figure 9J:
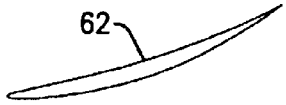
Figure 10:
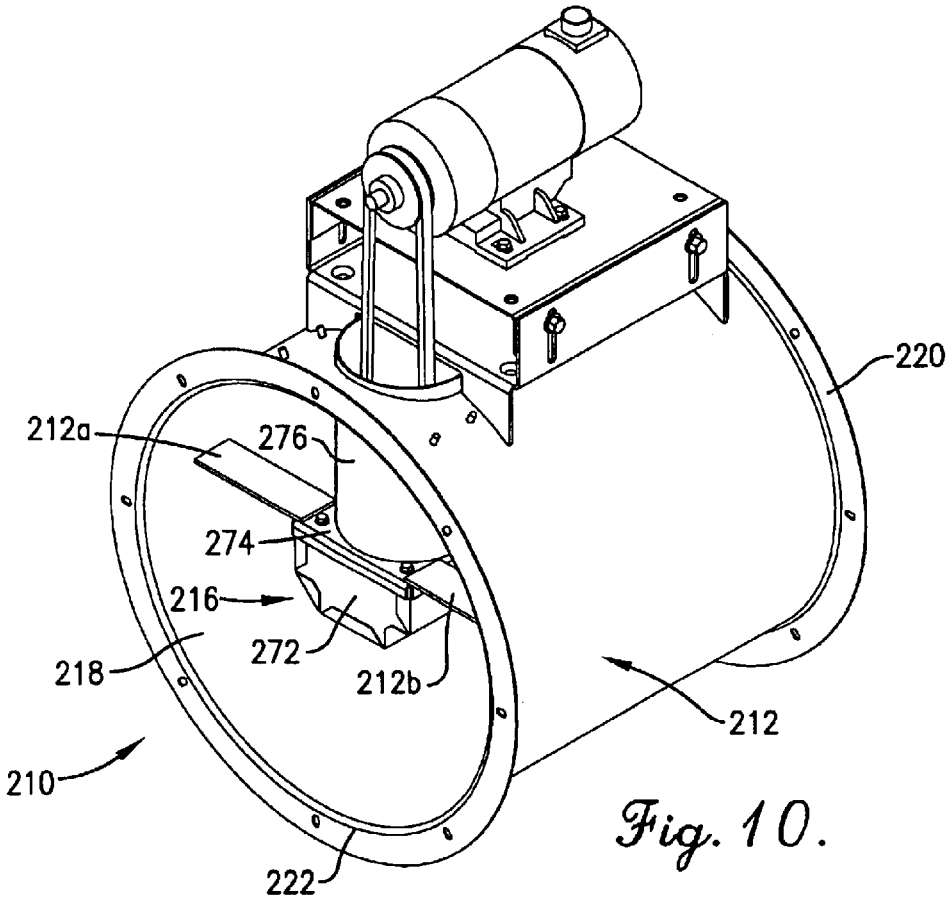
Figure 11:
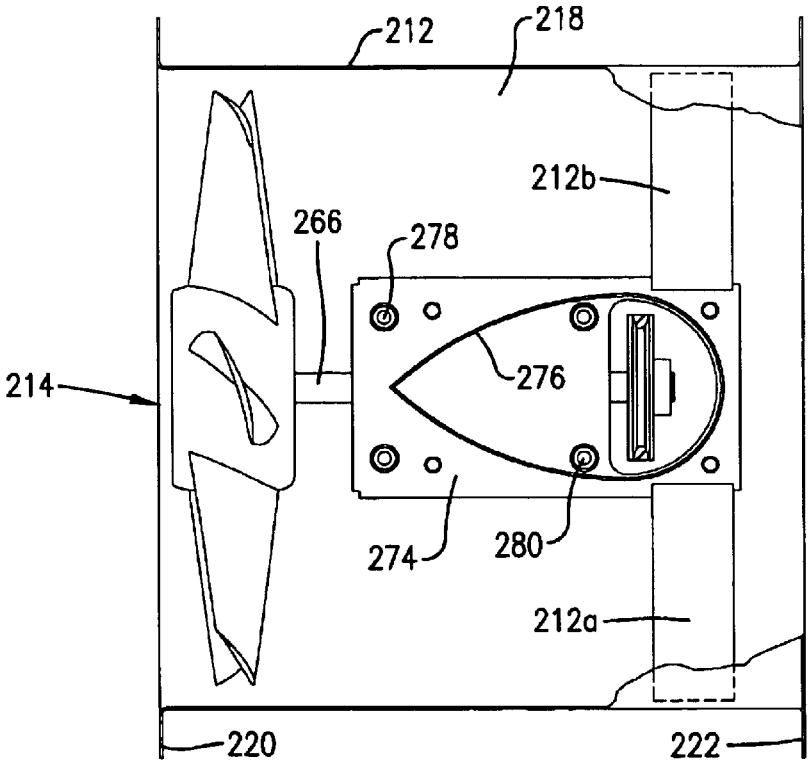

FIG. 9*a* is a sectional view the blade taken substantially along line 9*a*—9*a* of FIG. 8;

FIG. 9*b* is a sectional view the blade taken substantially along line 9*b*—9*b* of FIG. 8;

FIG. 9*c* is a sectional view the blade taken substantially along line 9*c*—9*c* of FIG. 8;

FIG. 9*d* is a sectional view the blade taken substantially along line 9*d*—9*d* of FIG. 8;

FIG. 9*e* is a sectional view the blade taken substantially along line 9*e*—9*e* of FIG. 8;

FIG. 9*f* is a sectional view the blade taken substantially along line 9*f*—9*f* of FIG. 8;

FIG. 9*g* is a sectional view the blade taken substantially along line 9*g*—9*g* of FIG. 8;

FIG. 9*h* is a sectional view the blade taken substantially along line 9*h*—9*h* of FIG. 8;

FIG. 9*i* is a sectional view the blade taken substantially along line 9*i*—9*i* of FIG. 8;

FIG. 9*j* is an end view the blade taken substantially along line 9*j*—9*j* of FIG. 8;

FIG. 10 is a perspective rear end view of a tubeaxial fan constructed in accordance with a preferred alternative embodiment of the present invention and having a support plates; and FIG. 11 is a plan view of the tubeaxial fan illustrated in FIG. 10 with portions of the drive assembly broken away and the propeller housing shown in fragmentary to illustrate the support plates.

DETAILED DESCRIPTION OF THE PREFERRED EMBODIMENTS

Figure 1:
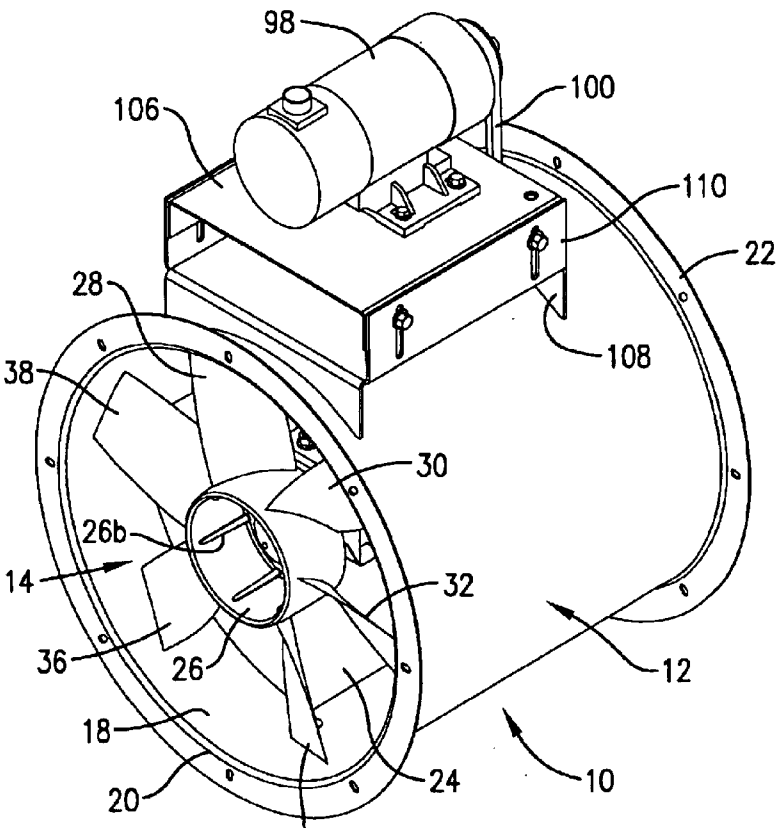
FIG. 1 is a perspective front end view of a tubeaxial fan constructed in accordance with a preferred embodiment of the present invention.

FIG. 1 illustrates a tubeaxial fan 10 constructed in accordance with a preferred embodiment of the present invention and configured for moving large amounts of air at relatively low noise levels. The principles of the present invention are particularly well-suited for tubeaxial fan applications, however, these principles are equally applicable to various other propeller and/or propeller housing applications having performance criteria consistent with tubeaxial fans (e.g., flow properties, pressure differentials, output efficiencies, vibration and noise levels, etc.). The tubeaxial fan 10 broadly includes a propeller cylinder 12, a propeller 14 rotatably supported in the cylinder 12, and a drive assembly 16 operable to rotate the propeller 14.

Figure 2:
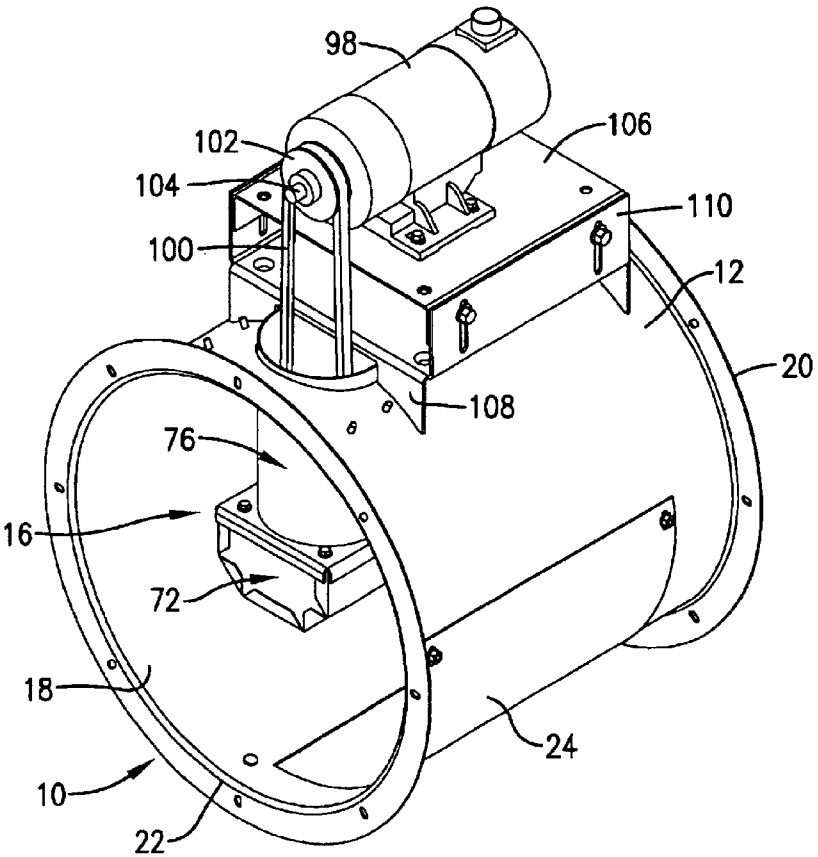
FIG. 2 is a perspective rear end view of the tubeaxial fan.

Turning initially to FIGS. 1 and 2, the illustrated propeller cylinder 12 is a cylindrically shaped tube presenting a cylindrical interior circumferential surface 18 that extends axially between opposite open ends 20 and 22. The ends 20 and 22 are flanged to facilitate attachment of the fan 10 to a mounting surface, for example duct work D (see FIG. 6). The open ends 20 and 22 allow air drawn by the propeller 14 to pass through the cylinder 12. It is believed that the preferred cylindrical shape facilitates optimum flow through the fan 10. However, it is within the ambit of the present invention to rotatably support the propeller 14 in a tubular propeller housing that utilizes various shapes other than cylindrical. It is further believed that flow properties of the fan 10 are also impacted by the amount of flow-restrictive structure within the cylinder 12 (e.g., structure for supporting the propeller 14 and components of the drive assembly 16). In this regard, the illustrated cylinder 12 is devoid of support structure that contacts the interior circumferential surface 18 at two points that are generally diametrically opposite. That is to say, components of the drive assembly 16 also function to support the drive assembly 16 and the propeller 14 in the cylinder 12 without the need for additional structure that solely serves the function of support. Such additional support structure is undesirable as it obstructs the airflow through the cylinder 12, particularly diametrically extending support structure. However, as discussed in detail below, it is within the ambit of the present invention to utilize such support structure, particularly in relatively larger diameter fans and particularly where the obstructive effects of the structure can be minimized. The cylinder 12 includes a removable access hatch 24 that provides access to the interior of the cylinder 12 to facilitate assembly and maintenance.

Figure 4:
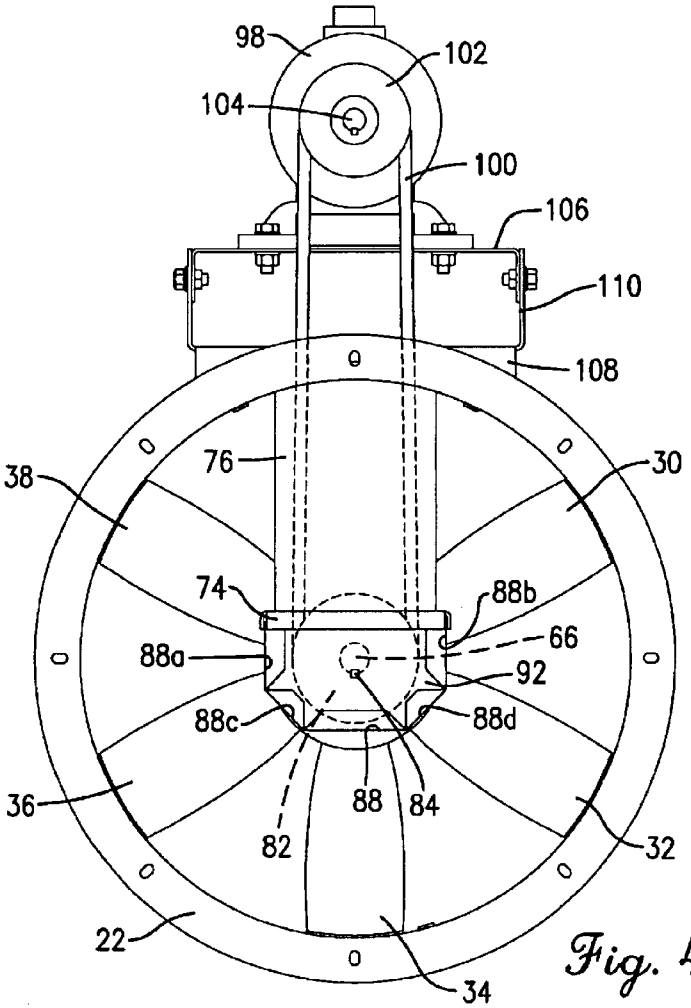
FIG. 4 is a rear elevational view of the tubeaxial fan.
Figure 3:
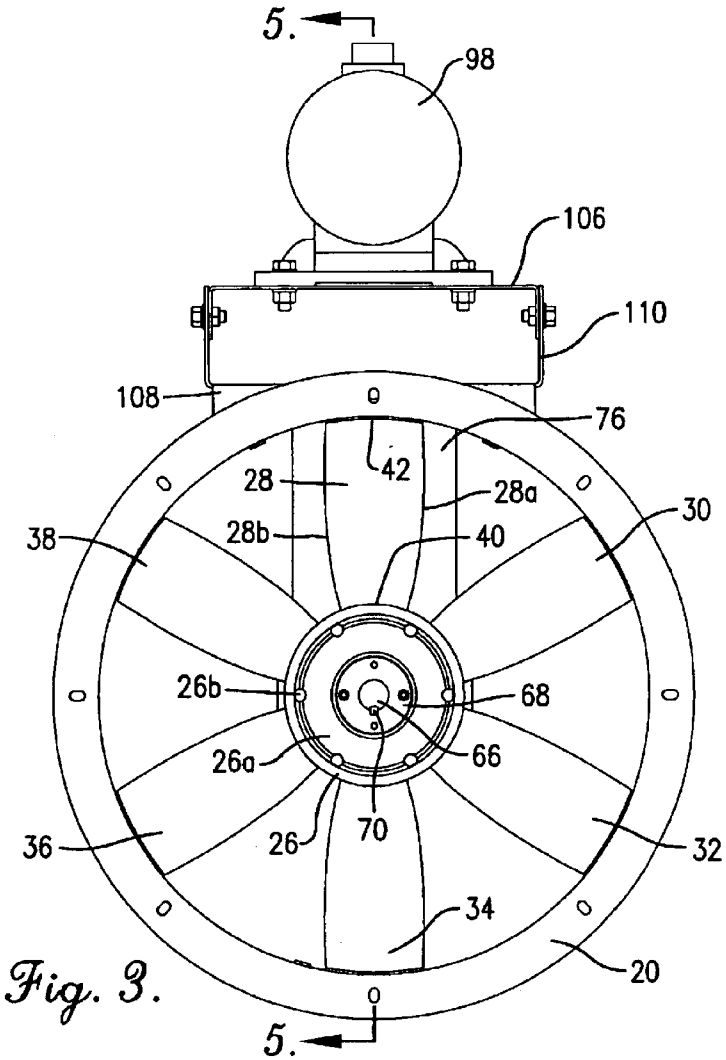
FIG. 3 is a front elevational view of the tubeaxial fan.
Figure 5:
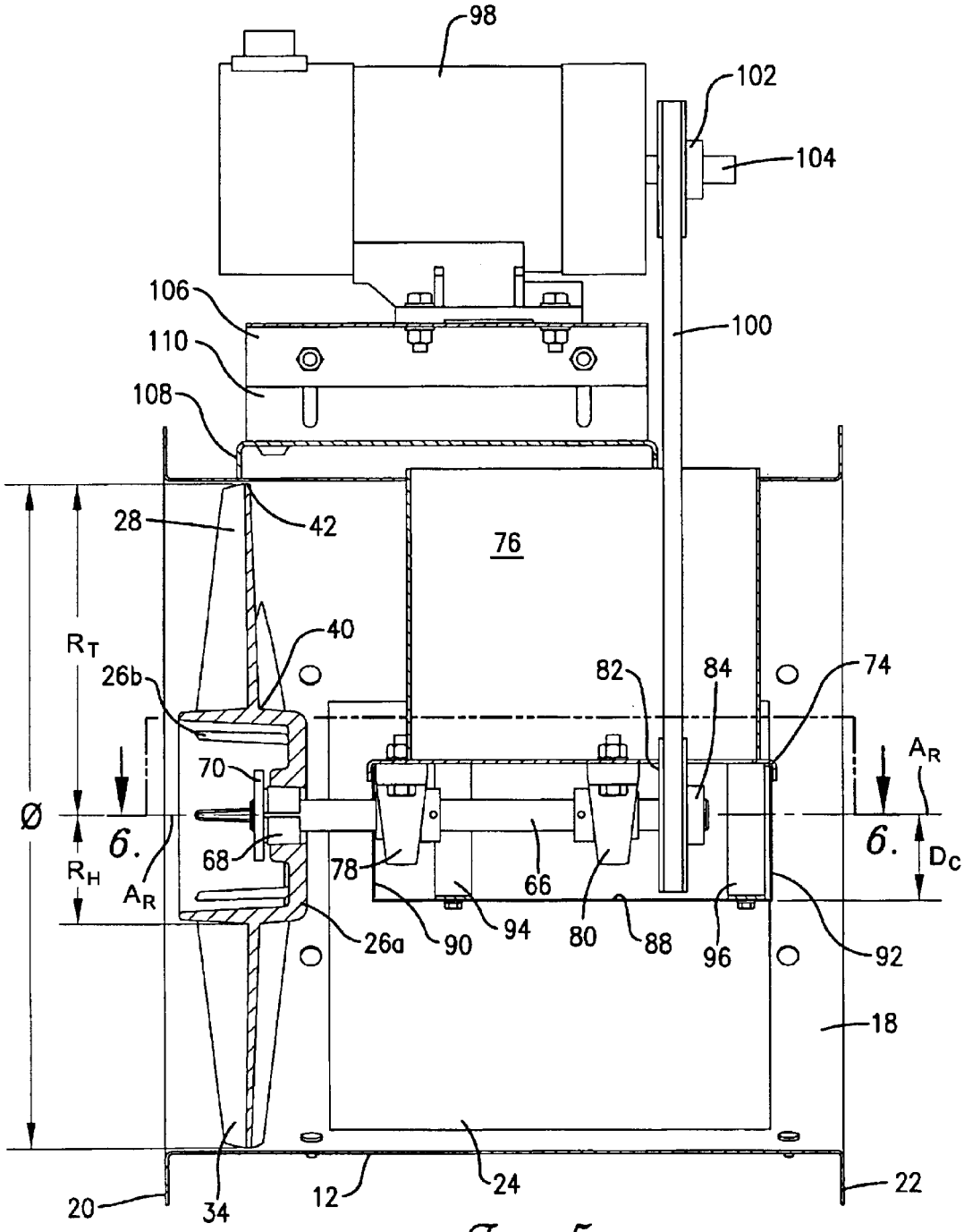
FIG. 5 is a sectional view of the tubeaxial fan taken substantially along line 5—5 of FIG. 3.

Turning to FIGS. 3–5, the propeller 14 is rotatably supported in the cylinder 12 for rotation about a center rotational axis $A_R$ (see FIG. 5). The propeller 14 includes a central hub 26 and blades 28, 30, 32, 34, 36, and 38 fixed to the hub 26 and projecting radially therefrom. The illustrated propeller 14 is a single cast component, for example one cast out of an aluminum allow. However, the hub and the blades could be separate parts that are assembled together in any manner known in the art. The blades 28,30,32,34,36,38 are virtually identical in construction, accordingly only the blade 28 will be described in detail with the understanding that the blades 30,32,34,36,38 are similarly configured. The blade 28 presents a root 40 adjacent the hub 26 and a tip 42 spaced radially outward from the root 40. The tip 42 is spaced from the rotational axis $A_R$ a tip radius $R_T$ (see FIG. 5). In the illustrated propeller 14, all of the blades 28,30, 32,34,36,38 have a uniform tip radii that are substantially equivalent. In addition, each blade is diametrically opposite a corresponding blade (e.g., the blade 28 is diametrically opposite of the blade 34) so that the two tip radii comprise a propeller diameter $\phi$ (see FIG. 5). In the illustrated fan 10, the tip radius $R_T$ is nine inches and the propeller diameter $\phi$ is eighteen inches with machining tolerances no greater than ±0.03 inches. However, it is within the ambit of the present invention to utilize various propeller dimensions, for example propeller diameters greater or smaller than eighteen inches or offset blades wherein the propeller diameter is calculated as twice the longest tip radius. The propeller cylinder 12 and the blades 28,30,32,34,36,38 are preferably configured so that the clearance between the interior circumferential surface 18 of the cylinder 12 and the blade tips is minimized as much as possible yet still provides sufficient rotational clearance. This tip clearance is preferably a maximum of one percent of the propeller diameter $\phi$. For example, in the illustrated fan 10 having an eighteen inch propeller diameter $\phi$, the tip clearance is preferably about 0.18 inches or less.

The hub 26 preferably presents a solid surface between the blade roots that generally obstructs the flow of air through the hub 26. It is believed that this configuration enhances the flow properties of the fan 10. Additionally, the hub 26 preferably defines a generally uniform hub radius $R_H$ between the rotational axis $A_R$ and each of the blade roots (see FIG. 5). The hub radius $R_H$ is preferably about one-third the tip radius $R_T$. In the illustrated fan 10, the hub radius $R_H$ is three inches with machining tolerances no greater than ±0.03 inches. The illustrated hub 26 is a walled cylinder having a closed end 26*a* downstream of the blades and being open on the opposite, upstream end. The closed end 26*a* cooperates with the hub wall and one or more components of the drive assembly 16 to comprise a solid surface that obstructs airflow through the hub 26. The hub 26 additionally includes a plurality of hub supports 26*b* spaced along the inside of the hub wall.

Figure 7:
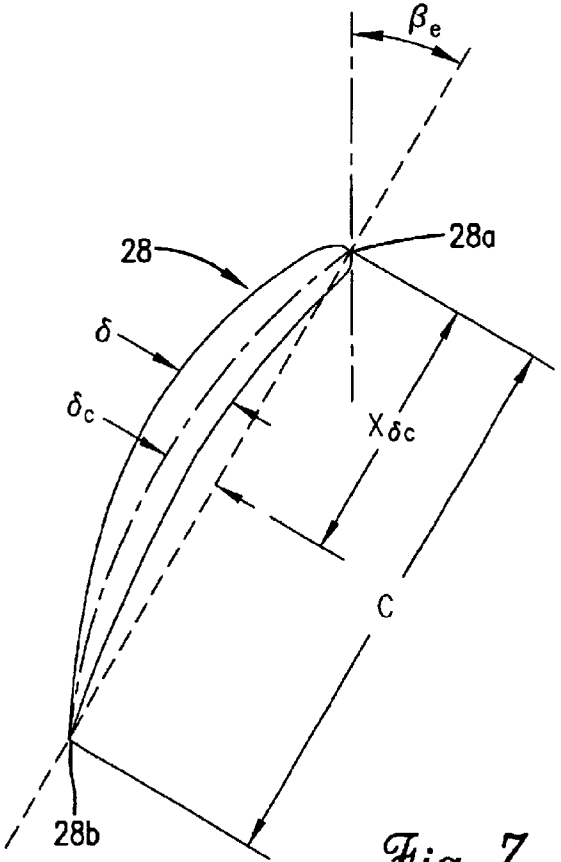
FIG. 7 is a schematic diagram of a cross-section of a blade of the tubeaxial fan illustrated in FIG. 1, illustrating various standard variables that define the airfoil of the blade.

As schematically diagramed in FIG. 7, the blade 28 is an airfoil presenting certain design variables including among others a chord length C, a stagger angle $\beta_c$, a camber height $\delta_c$, and a blade thickness $\delta$. As described in more detail below, the inventive design of the blade 28 provides for fan operation that is more efficient and less noisy than heretofore available. In addition to the previously indicated variables, the following variables, recognized in the industry, are some of many, that either influence, and/or are a product of, the blade design. The axial velocities, both average and exit velocities, measured in feet per minute, are components of air velocity exiting the blade at a specified radial position along the blade. The loading factor is a dimensionless percentage that defines the distribution of energy transfer at a specified radial position along the blade. The ratio of outlet and inlet relative velocity is a dimensionless ratio that compares components of air velocity entering and exiting the blade at a specified radial position along the blade. The inlet and outlet flow angles, measured in degrees, compare the relative velocity vector with the rotating velocity vector at inlet and outlet, respectively, at a specified radial position along the blade.

The table on the following page entitled: TABLE 1 Design Variables of Blade 28, lists values of certain design variables at the given radial positions for the blade 28 of the illustrated fan 10. The radial positions are measured, in inches, along the tip radius $R_T$ from the rotational axis $A_R$. The values listed in TABLE 1 are based on the illustrated propeller 14 (having the six blades 28,30,32,34,36,38, and the propeller diameter $\phi$ of eighteen inches) formed from aluminum alloy 356.1, rotating at 1800 rpm, having a flow rate of 4000 cfm at a static pressure of 0.5 in.wg.

The camber height $\delta_c$ is the distance between a line connecting the leading and trailing edges and a camber line, measured in inches. The camber height values listed in TABLE 1 above correspond to the greatest camber height between the leading edge 28*a* and the trailing edge 28*b* at the given radial position. The camber height $\delta_c$ varies between the root 40 and the tip 42 presenting a maximum camber height $\delta_{cmax}$ at a location $X\delta_c$ between the root 40 and the tip 42. The camber height $\delta_c$ preferably falls within a range between and including 1.7 percent to 3.8 percent of the tip radius $R_T$. The camber height $\delta_c$ progressively and gradually increases from the root 40 to the maximum camber height location $X\delta_c$ and progressively and gradually increases from the tip 42 to the maximum camber height location $X\delta_c$. The maximum camber height location $X\delta_c$ is preferably between seventy percent and seventy-eight percent of the tip radius $R_T$ from the rotational axis $A_R$. As shown in TABLE 1 above, the maximum camber height location $X\delta_c$ of the illustrated blade 28 is located at a radial position between 6.3333 and 7 inches.

TABLE 1

Design Variables of Blade 28

| | Radial Positions (Inch) | | | | | | | | | |
|---|---|---|---|---|---|---|---|---|---|---|
| | 3 | 3.6667 | 4.3333 | 5 | 5.6667 | 6.3333 | 7 | 7.6667 | 8.3333 | 9 |
| Average axial velocity (ft/min) | 2144.0639 | 2298.717 | 2423.2245 | 2518.3248 | 2587.803 | 2632.9615 | 2654.0658 | 2650.4755 | 2618.6865 | 2556.8869 |
| Axial velocity at exit (ft/min) | 1716.5713 | 1990.2609 | 2231.4178 | 2429.4882 | 2580.751 | 2682.9892 | 2734.1882 | 2731.6183 | 2670.2484 | 2542.2172 |
| LOADING factor | 0.5961 | 0.7353 | 0.8511 | 0.9435 | 1.0126 | 1.0583 | 1.0807 | 1.0796 | 1.0552 | 1.0075 |
| RATIO of outlet and inlet relative velocity | 0.5402 | 0.6278 | 0.6945 | 0.7458 | 0.786 | 0.818 | 0.8439 | 0.8651 | 0.8828 | 0.8973 |
| Inlet flow angle | 47.7061 | 53.3386 | 57.7966 | 61.3725 | 64.2834 | 66.6875 | 68.6999 | 70.4051 | 71.8661 | 73.1303 |
| Outlet flow angle | 33.7464 | 41.4786 | 47.3517 | 52.0553 | 56.0171 | 59.4997 | 62.6695 | 65.6409 | 68.5075 | 71.3533 |
| Stagger angle | 41.8868 | 47.5383 | 52.1081 | 55.8797 | 59.056 | 61.8126 | 64.2918 | 66.6187 | 68.9353 | 71.3906 |
| Ratio of camber height to chord length | 0.0645 | 0.0697 | 0.0759 | 0.082 | 0.0872 | 0.0903 | 0.0903 | 0.0852 | 0.0723 | 0.0467 |
| Camber height (inch) | 0.2212 | 0.2471 | 0.2754 | 0.3024 | 0.324 | 0.3357 | 0.3328 | 0.3093 | 0.2563 | 0.1602 |
| Chord length (inch) | 3.4294 | 3.5441 | 3.6301 | 3.6875 | 3.7162 | 3.7162 | 3.6875 | 3.6301 | 3.5441 | 3.4294 |
| Soildity | 1.0916 | 0.923 | 0.8 | 0.7043 | 0.6262 | 0.5603 | 0.503 | 0.4522 | 0.4061 | 0.3639 |
| Blade thickness (inch) | 0.2953 | 0.2841 | 0.273 | 0.2618 | 0.2507 | 0.2395 | 0.2283 | 0.2172 | 0.206 | 0.1949 |

The chord length C is the distance, measured in inches, between a leading edge 28*a* of the airfoil and a trailing edge 28*b* of the airfoil. The leading and trailing nature of the edges 28*a*,28*b* is relative to the direction of rotation of the propeller 14. In the illustrated fan 10, the propeller 14 rotates clockwise when viewed from the end 20 (as in FIG. 3). The chord length C varies between the root 40 and the tip 42 presenting a maximum chord length $C_{max}$ at a location $XC_{max}$ between the root 40 and the tip 42. The chord length C preferably falls within a range between and including thirty-eight to forty-two percent of the tip radius $R_T$. The chord length C progressively and gradually increases from the root 40 to the maximum chord length location $XC_{max}$ and progressively and gradually increases from the tip 42 to the maximum chord length location $XC_{max}$. The maximum chord length location $XC_{max}$ is preferably between sixty-three percent and seventy-one percent of the tip radius $R_T$ from the rotational axis $A_R$. As shown in TABLE 1 above, the maximum chord length $XC_{max}$ of the illustrated blade 28 is located at a radial position between 5.6667 and 6.3333 inches.

The stagger angle $\beta_e$ is the pitch of the airfoil, measured in degrees, relative to the rotational axis $A_R$. The stagger angle $\beta_e$ varies between the root 40 and the tip 42 and is relatively greater at the tip 42 than at the root 40. The stagger angle $\beta_e$ is preferably at least forty degrees at the root 40 and less than seventy-two degrees at the tip 42. The stagger angle progressively and gradually increases from the root 40 to the tip 42. As shown in TABLE 1 above, the stagger angle $\beta_e$ of the illustrated blade 28 is 41.8868 at the three inch radial position and 71.3906 at the nine inch radial position.

The blade thickness $\delta$, measured in inches, varies along the chord length C from the leading edge 28*a* to the trailing edge 28*b* and varies along the tip radius $R_T$ from the root 40 to the tip 42. The blade thickness values listed in TABLE 1 above correspond to the greatest blade thickness between the leading edge 28*a* and the trailing edge 28*b* at the given radial position. The blade thickness for the illustrated blade 28 constructed of the aluminum alloy preferably is less than about 0.3 inches at the root 40 and progressively decreases towards the tip 42 where the thickness is preferably less than about 0.2 inches. As shown in TABLE 1 above, the blade thickness $\delta$ of the illustrated blade 28 at the radial position 3 inches is 0.2953 inches and at the radial position 9 inches is 0.1949 inches.

The values listed in TABLE 1 above can be applied to a NACA 65 airfoil design to arrive at the shape of the blade 28 of the illustrated embodiment. In particular, and turning to FIGS. 8–9*j*, the blade 28 includes an external surface having a shape defined by the relative positioning of a plurality of coordinates contained in cross-sections 44, 46, 48, 50, 52, 54, 56, 58, and 60. The cross-sections are arcuate sections with a section 62 being an arcuate end section. The plurality of coordinates are defined on a three-dimensional grid 64 having its origin on the rotational axis $A_R$ and including X, Y, and Z axes. The X axis extends radially from the origin. The Y axis is coplanar with the X axis and extends from the origin orthogonally to the X axis. The Z axis corresponds with the rotational axis $A_R$. The cross-sections 44,46,48,50,52,54,56,58,60 of the illustrated blade 28 have the corresponding plurality of coordinates listed in the following TABLE 2 wherein coordinates a1–a96 correspond with cross-section 44 (see FIG. 9*a*), coordinates b1–b96 correspond with cross-section 46 (see FIG. 9*b*), coordinates c1–c96 correspond with cross-section 48 (see FIG. 9*c*), coordinates d1–d96 correspond with cross-section 50 (see FIG. 9*d*), coordinates e1–e96 correspond with cross-section 52 (see FIG. 9*e*), coordinates f1–f96 correspond with cross-section 54 (see FIG. 9*f*), coordinates g1–g96 correspond with cross-section 56 (see FIG. 9*g*), coordinates h1–h96 correspond with cross-section 58 (see FIG. 9*h*), coordinates i1–i96 correspond with cross-section 60 (see FIG. 9*i*), and coordinates j1–j96 correspond with end section 62 (see FIG. 9*j*):

TABLE 2

Cross-sectional Coordinates for Blade 28

| Coordinate # | X | Y | Z |
|---|---|---|---|
| a1 | 2.7720 | −1.1473 | −1.3127 |
| a2 | 2.7718 | −1.1477 | −1.3120 |
| a3 | 2.7717 | −1.1478 | −1.3117 |
| a4 | 2.7717 | −1.1480 | −1.3113 |
| a5 | 2.7716 | −1.1483 | −1.3107 |
| a6 | 2.7714 | −1.1485 | −1.3098 |
| a7 | 2.7713 | −1.1488 | −1.3084 |
| a8 | 2.7713 | −1.1489 | −1.3062 |
| a9 | 2.7714 | −1.1486 | −1.3027 |
| a10 | 2.7720 | −1.1471 | −1.2971 |
| a11 | 2.7741 | −1.1422 | −1.2889 |
| a12 | 2.7761 | −1.1371 | −1.2809 |
| a13 | 2.7806 | −1.1263 | −1.2661 |
| a14 | 2.7922 | −1.0970 | −1.2326 |
| a15 | 2.8158 | −1.0351 | −1.1708 |
| a16 | 2.8380 | −0.9725 | −1.1099 |
| a17 | 2.8588 | −0.9095 | −1.0498 |
| a18 | 2.8961 | −0.7828 | −0.9305 |
| a19 | 2.9274 | −0.6562 | −0.8111 |
| a20 | 2.9528 | −0.5302 | −0.6911 |
| a21 | 2.9725 | −0.4052 | −0.5700 |
| a22 | 2.9866 | −0.2831 | −0.4462 |
| a23 | 2.9958 | −0.1593 | −0.3239 |
| a24 | 2.9997 | −0.0402 | −0.1974 |
| a25 | 2.9989 | 0.0807 | −0.0724 |
| a26 | 2.9935 | 0.1971 | 0.0568 |
| a27 | 2.9834 | 0.3149 | 0.1848 |
| a28 | 2.9694 | 0.4276 | 0.3177 |
| a29 | 2.9508 | 0.5410 | 0.4501 |
| a30 | 2.9287 | 0.6503 | 0.5863 |
| a31 | 2.9030 | 0.7568 | 0.7253 |
| a32 | 2.8741 | 0.8599 | 0.8673 |
| a33 | 2.8425 | 0.9594 | 1.0125 |
| a34 | 2.8083 | 1.0551 | 1.1611 |
| a35 | 2.7906 | 1.1011 | 1.2369 |
| a36 | 2.7815 | 1.1240 | 1.2749 |
| a37 | 2.7768 | 1.1355 | 1.2939 |
| a38 | 2.7745 | 1.1412 | 1.3034 |
| a39 | 2.7721 | 1.1469 | 1.3129 |
| a40 | 2.7718 | 1.1478 | 1.3143 |
| a41 | 2.7716 | 1.1482 | 1.3150 |
| a42 | 2.7715 | 1.1484 | 1.3153 |
| a43 | 2.7714 | 1.1486 | 1.3154 |
| a44 | 2.7714 | 1.1486 | 1.3155 |
| a45 | 2.7714 | 1.1487 | 1.3155 |
| a46 | 2.7714 | 1.1487 | 1.3156 |
| a47 | 2.7714 | 1.1487 | 1.3156 |
| a48 | 2.7713 | 1.1488 | 1.3156 |
| a49 | 2.7713 | 1.1488 | 1.3156 |
| a50 | 2.7713 | 1.1488 | 1.3155 |
| a51 | 2.7713 | 1.1488 | 1.3155 |
| a52 | 2.7713 | 1.1488 | 1.3155 |

TABLE 2-continued

Cross-sectional Coordinates for Blade 28

| Coordinate # | X | Y | Z |
|---|---|---|---|
| a53 | 2.7713 | 1.1488 | 1.3154 |
| a54 | 2.7713 | 1.1488 | 1.3153 |
| a55 | 2.7714 | 1.1487 | 1.3151 |
| a56 | 2.7714 | 1.1486 | 1.3147 |
| a57 | 2.7715 | 1.1483 | 1.3140 |
| a58 | 2.7718 | 1.1477 | 1.3125 |
| a59 | 2.7736 | 1.1432 | 1.3022 |
| a60 | 2.7755 | 1.1388 | 1.2920 |
| a61 | 2.7791 | 1.1299 | 1.2714 |
| a62 | 2.7863 | 1.1121 | 1.2304 |
| a63 | 2.8003 | 1.0763 | 1.1481 |
| a64 | 2.8281 | 1.0009 | 0.9861 |
| a65 | 2.8550 | 0.9215 | 0.8264 |
| a66 | 2.8806 | 0.8380 | 0.6691 |
| a67 | 2.9047 | 0.7500 | 0.5145 |
| a68 | 2.9272 | 0.6571 | 0.3627 |
| a69 | 2.9477 | 0.5576 | 0.2156 |
| a70 | 2.9651 | 0.4561 | 0.0690 |
| a71 | 2.9800 | 0.3462 | −0.0712 |
| a72 | 2.9909 | 0.2341 | −0.2101 |
| a73 | 2.9979 | 0.1135 | −0.3420 |
| a74 | 3.0000 | −0.0090 | −0.4724 |
| a75 | 2.9968 | −0.1392 | −0.5957 |
| a76 | 2.9878 | −0.2703 | −0.7175 |
| a77 | 2.9723 | −0.4067 | −0.8335 |
| a78 | 2.9498 | −0.5465 | −0.9450 |
| a79 | 2.9197 | −0.6893 | −1.0514 |
| a80 | 2.8815 | −0.8350 | −1.1522 |
| a81 | 2.8590 | −0.9090 | −1.2001 |
| a82 | 2.8341 | −0.9839 | −1.2458 |
| a83 | 2.8066 | −1.0597 | −1.2891 |
| a84 | 2.7913 | −1.0993 | −1.3076 |
| a85 | 2.7846 | −1.1161 | −1.3135 |
| a86 | 2.7811 | −1.1249 | −1.3158 |
| a87 | 2.7775 | −1.1337 | −1.3180 |
| a88 | 2.7753 | −1.1391 | −1.3175 |
| a89 | 2.7740 | −1.1422 | −1.3166 |
| a90 | 2.7733 | −1.1441 | −1.3158 |
| a91 | 2.7728 | −1.1452 | −1.3150 |
| a92 | 2.7725 | −1.1459 | −1.3144 |
| a93 | 2.7723 | −1.1463 | −1.3139 |
| a94 | 2.7722 | −1.1466 | −1.3136 |
| a95 | 2.7721 | −1.1468 | −1.3133 |
| a96 | 2.7720 | −1.1473 | −1.3127 |
| b1 | 3.4431 | −1.3147 | −1.2302 |
| b2 | 3.4430 | −1.3151 | −1.2295 |
| b3 | 3.4429 | −1.3152 | −1.2291 |
| b4 | 3.4428 | −1.3153 | −1.2287 |
| b5 | 3.4428 | −1.3155 | −1.2280 |
| b6 | 3.4427 | −1.3157 | −1.2270 |
| b7 | 3.4426 | −1.3159 | −1.2256 |
| b8 | 3.4427 | −1.3158 | −1.2233 |
| b9 | 3.4429 | −1.3151 | −1.2198 |
| b10 | 3.4437 | −1.3130 | −1.2142 |
| b11 | 3.4460 | −1.3071 | −1.2063 |
| b12 | 3.4482 | −1.3011 | −1.1986 |
| b13 | 3.4530 | −1.2884 | −1.1846 |
| b14 | 3.4654 | −1.2548 | −1.1533 |
| b15 | 3.4900 | −1.1846 | −1.0965 |
| b16 | 3.5132 | −1.1138 | −1.0407 |
| b17 | 3.5350 | −1.0427 | −0.9856 |
| b18 | 3.5740 | −0.9000 | −0.8763 |
| b19 | 3.6069 | −0.7575 | −0.7669 |
| b20 | 3.6338 | −0.6156 | −0.6565 |
| b21 | 3.6549 | −0.4747 | −0.5448 |
| b22 | 3.6702 | −0.3366 | −0.4301 |
| b23 | 3.6803 | −0.1968 | −0.3169 |
| b24 | 3.6850 | −0.0614 | −0.1989 |
| b25 | 3.6848 | 0.0757 | −0.0827 |
| b26 | 3.6797 | 0.2085 | 0.0384 |
| b27 | 3.6696 | 0.3428 | 0.1580 |
| b28 | 3.6552 | 0.4723 | 0.2831 |
| b29 | 3.6360 | 0.6025 | 0.4075 |
| b30 | 3.6127 | 0.7290 | 0.5363 |
| b31 | 3.5855 | 0.8528 | 0.6681 |

TABLE 2-continued

Cross-sectional Coordinates for Blade 28

| Coordinate # | X | Y | Z |
|---|---|---|---|
| b32 | 3.5547 | 0.9735 | 0.8032 |
| b33 | 3.5204 | 1.0908 | 0.9419 |
| b34 | 3.4832 | 1.2044 | 1.0843 |
| b35 | 3.4637 | 1.2595 | 1.1573 |
| b36 | 3.4536 | 1.2870 | 1.1939 |
| b37 | 3.4484 | 1.3007 | 1.2122 |
| b38 | 3.4458 | 1.3075 | 1.2213 |
| b39 | 3.4432 | 1.3144 | 1.2305 |
| b40 | 3.4428 | 1.3154 | 1.2318 |
| b41 | 3.4426 | 1.3159 | 1.2324 |
| b42 | 3.4425 | 1.3162 | 1.2327 |
| b43 | 3.4425 | 1.3163 | 1.2329 |
| b44 | 3.4424 | 1.3164 | 1.2329 |
| b45 | 3.4424 | 1.3164 | 1.2330 |
| b46 | 3.4424 | 1.3165 | 1.2330 |
| b47 | 3.4424 | 1.3165 | 1.2330 |
| b48 | 3.4424 | 1.3165 | 1.2330 |
| b49 | 3.4424 | 1.3165 | 1.2330 |
| b50 | 3.4424 | 1.3165 | 1.2330 |
| b51 | 3.4424 | 1.3165 | 1.2329 |
| b52 | 3.4424 | 1.3165 | 1.2329 |
| b53 | 3.4424 | 1.3165 | 1.2329 |
| b54 | 3.4424 | 1.3165 | 1.2327 |
| b55 | 3.4424 | 1.3164 | 1.2325 |
| b56 | 3.4425 | 1.3163 | 1.2322 |
| b57 | 3.4426 | 1.3159 | 1.2314 |
| b58 | 3.4429 | 1.3151 | 1.2299 |
| b59 | 3.4451 | 1.3095 | 1.2199 |
| b60 | 3.4472 | 1.3039 | 1.2098 |
| b61 | 3.4514 | 1.2927 | 1.1897 |
| b62 | 3.4597 | 1.2703 | 1.1494 |
| b63 | 3.4760 | 1.2252 | 1.0687 |
| b64 | 3.5076 | 1.1313 | 0.9103 |
| b65 | 3.5377 | 1.0334 | 0.7546 |
| b66 | 3.5659 | 0.9314 | 0.6017 |
| b67 | 3.5921 | 0.8249 | 0.4519 |
| b68 | 3.6158 | 0.7137 | 0.3056 |
| b69 | 3.6370 | 0.5961 | 0.1647 |
| b70 | 3.6546 | 0.4765 | 0.0244 |
| b71 | 3.6690 | 0.3491 | −0.1085 |
| b72 | 3.6790 | 0.2195 | −0.2400 |
| b73 | 3.6846 | 0.0819 | −0.3633 |
| b74 | 3.6851 | −0.0574 | −0.4849 |
| b75 | 3.6799 | −0.2037 | −0.5984 |
| b76 | 3.6688 | −0.3509 | −0.7103 |
| b77 | 3.6511 | −0.5028 | −0.8157 |
| b78 | 3.6264 | −0.6578 | −0.9159 |
| b79 | 3.5942 | −0.8155 | −1.0105 |
| b80 | 3.5541 | −0.9757 | −1.0989 |
| b81 | 3.5308 | −1.0569 | −1.1402 |
| b82 | 3.5052 | −1.1388 | −1.1792 |
| b83 | 3.4772 | −1.2215 | −1.2155 |
| b84 | 3.4619 | −1.2644 | −1.2302 |
| b85 | 3.4553 | −1.2824 | −1.2344 |
| b86 | 3.4518 | −1.2917 | −1.2359 |
| b87 | 3.4482 | −1.3011 | −1.2371 |
| b88 | 3.4461 | −1.3067 | −1.2360 |
| b89 | 3.4449 | −1.3098 | −1.2348 |
| b90 | 3.4443 | −1.3117 | −1.2337 |
| b91 | 3.4438 | −1.3128 | −1.2328 |
| b92 | 3.4436 | −1.3134 | −1.2321 |
| b93 | 3.4434 | −1.3139 | −1.2316 |
| b94 | 3.4433 | −1.3141 | −1.2312 |
| b95 | 3.4432 | −1.3143 | −1.2309 |
| b96 | 3.4431 | −1.3147 | −1.2302 |
| c1 | 4.1253 | −1.4452 | −1.1463 |
| c2 | 4.1252 | −1.4455 | −1.1456 |
| c3 | 4.1251 | −1.4456 | −1.1452 |
| c4 | 4.1251 | −1.4458 | −1.1447 |
| c5 | 4.1250 | −1.4459 | −1.1440 |
| c6 | 4.1250 | −1.4460 | −1.1430 |
| c7 | 4.1250 | −1.4461 | −1.1415 |
| c8 | 4.1251 | −1.4458 | −1.1392 |
| c9 | 4.1254 | −1.4448 | −1.1357 |
| c10 | 4.1263 | −1.4423 | −1.1301 |

TABLE 2-continued

Cross-sectional Coordinates for Blade 28

| Coordinate # | X | Y | Z |
|---|---|---|---|
| c11 | 4.1287 | −1.4356 | −1.1226 |
| c12 | 4.1310 | −1.4288 | −1.1153 |
| c13 | 4.1359 | −1.4146 | −1.1021 |
| c14 | 4.1484 | −1.3775 | −1.0731 |
| c15 | 4.1731 | −1.3008 | −1.0211 |
| c16 | 4.1963 | −1.2236 | −0.9702 |
| c17 | 4.2181 | −1.1462 | −0.9200 |
| c18 | 4.2573 | −0.9911 | −0.8205 |
| c19 | 4.2904 | −0.8363 | −0.7207 |
| c20 | 4.3175 | −0.6822 | −0.6198 |
| c21 | 4.3390 | −0.5292 | −0.5174 |
| c22 | 4.3547 | −0.3787 | −0.4116 |
| c23 | 4.3652 | −0.2268 | −0.3075 |
| c24 | 4.3704 | −0.0789 | −0.1981 |
| c25 | 4.3705 | 0.0705 | −0.0906 |
| c26 | 4.3658 | 0.2160 | 0.0221 |
| c27 | 4.3560 | 0.3630 | 0.1333 |
| c28 | 4.3418 | 0.5055 | 0.2504 |
| c29 | 4.3227 | 0.6488 | 0.3667 |
| c30 | 4.2994 | 0.7887 | 0.4877 |
| c31 | 4.2719 | 0.9261 | 0.6119 |
| c32 | 4.2404 | 1.0608 | 0.7396 |
| c33 | 4.2054 | 1.1922 | 0.8713 |
| c34 | 4.1670 | 1.3203 | 1.0070 |
| c35 | 4.1467 | 1.3827 | 1.0768 |
| c36 | 4.1361 | 1.4138 | 1.1117 |
| c37 | 4.1308 | 1.4294 | 1.1292 |
| c38 | 4.1281 | 1.4371 | 1.1379 |
| c39 | 4.1254 | 1.4449 | 1.1466 |
| c40 | 4.1250 | 1.4460 | 1.1479 |
| c41 | 4.1248 | 1.4466 | 1.1485 |
| c42 | 4.1247 | 1.4469 | 1.1488 |
| c43 | 4.1246 | 1.4471 | 1.1489 |
| c44 | 4.1246 | 1.4472 | 1.1490 |
| c45 | 4.1246 | 1.4472 | 1.1490 |
| c46 | 4.1246 | 1.4473 | 1.1490 |
| c47 | 4.1246 | 1.4473 | 1.1490 |
| c48 | 4.1245 | 1.4473 | 1.1490 |
| c49 | 4.1245 | 1.4473 | 1.1490 |
| c50 | 4.1245 | 1.4473 | 1.1490 |
| c51 | 4.1245 | 1.4473 | 1.1490 |
| c52 | 4.1245 | 1.4473 | 1.1489 |
| c53 | 4.1245 | 1.4473 | 1.1489 |
| c54 | 4.1246 | 1.4473 | 1.1488 |
| c55 | 4.1246 | 1.4472 | 1.1486 |
| c56 | 4.1247 | 1.4470 | 1.1482 |
| c57 | 4.1248 | 1.4465 | 1.1475 |
| c58 | 4.1251 | 1.4456 | 1.1460 |
| c59 | 4.1274 | 1.4391 | 1.1363 |
| c60 | 4.1297 | 1.4325 | 1.1265 |
| c61 | 4.1342 | 1.4194 | 1.1069 |
| c62 | 4.1431 | 1.3932 | 1.0677 |
| c63 | 4.1605 | 1.3404 | 0.9893 |
| c64 | 4.1941 | 1.2314 | 0.8356 |
| c65 | 4.2256 | 1.1184 | 0.6849 |
| c66 | 4.2548 | 1.0015 | 0.5375 |
| c67 | 4.2816 | 0.8802 | 0.3935 |
| c68 | 4.3055 | 0.7544 | 0.2534 |
| c69 | 4.3265 | 0.6226 | 0.1193 |
| c70 | 4.3437 | 0.4889 | −0.0141 |
| c71 | 4.3573 | 0.3477 | −0.1393 |
| c72 | 4.3683 | 0.2045 | −0.2629 |
| c73 | 4.3708 | 0.0540 | −0.3776 |
| c74 | 4.3700 | −0.0981 | −0.4904 |
| c75 | 4.3636 | −0.2568 | −0.5944 |
| c76 | 4.3513 | −0.4161 | −0.6966 |
| c77 | 4.3325 | −0.5799 | −0.7917 |
| c78 | 4.3069 | −0.7463 | −0.8812 |
| c79 | 4.2742 | −0.9152 | −0.9647 |
| c80 | 4.2339 | −1.0864 | −1.0414 |
| c81 | 4.2108 | −1.1729 | −1.0767 |
| c82 | 4.1855 | −1.2601 | −1.1095 |
| c83 | 4.1580 | −1.3481 | −1.1394 |
| c84 | 4.1431 | −1.3934 | −1.1507 |
| c85 | 4.1367 | −1.4123 | −1.1535 |

TABLE 2-continued

Cross-sectional Coordinates for Blade 28

| Coordinate # | X | Y | Z |
|---|---|---|---|
| c86 | 4.1334 | −1.4220 | −1.1541 |
| c87 | 4.1300 | −1.4318 | −1.1546 |
| c88 | 4.1280 | −1.4374 | −1.1530 |
| c89 | 4.1269 | −1.4406 | −1.1515 |
| c90 | 4.1263 | −1.4424 | −1.1502 |
| c91 | 4.1259 | −1.4434 | −1.1492 |
| c92 | 4.1257 | −1.4441 | −1.1484 |
| c93 | 4.1255 | −1.4445 | −1.1478 |
| c94 | 4.1255 | −1.4447 | −1.1474 |
| c95 | 4.1254 | −1.4449 | −1.1471 |
| c96 | 4.1253 | −1.4452 | −1.1463 |
| d1 | 4.8150 | −1.5445 | −1.0635 |
| d2 | 4.8149 | −1.5448 | −1.0627 |
| d3 | 4.8149 | −1.5449 | −1.0624 |
| d4 | 4.8149 | −1.5450 | −1.0619 |
| d5 | 4.8148 | −1.5451 | −1.0612 |
| d6 | 4.8148 | −1.5451 | −1.0601 |
| d7 | 4.8148 | −1.5451 | −1.0586 |
| d8 | 4.8150 | −1.5447 | −1.0563 |
| d9 | 4.8154 | −1.5434 | −1.0527 |
| d10 | 4.8163 | −1.5405 | −1.0473 |
| d11 | 4.8187 | −1.5331 | −1.0402 |
| d12 | 4.8210 | −1.5257 | −1.0332 |
| d13 | 4.8258 | −1.5104 | −1.0208 |
| d14 | 4.8381 | −1.4706 | −0.9940 |
| d15 | 4.8622 | −1.3889 | −0.9468 |
| d16 | 4.8849 | −1.3069 | −0.9006 |
| d17 | 4.9061 | −1.2248 | −0.8551 |
| d18 | 4.9442 | −1.0603 | −0.7649 |
| d19 | 4.9766 | −0.8963 | −0.6743 |
| d20 | 5.0032 | −0.7332 | −0.5825 |
| d21 | 5.0243 | −0.5711 | −0.4890 |
| d22 | 5.0399 | −0.4114 | −0.3919 |
| d23 | 5.0505 | −0.2504 | −0.2965 |
| d24 | 5.0558 | −0.0933 | −0.1955 |
| d25 | 5.0562 | 0.0654 | −0.0965 |
| d26 | 5.0519 | 0.2205 | 0.0080 |
| d27 | 5.0426 | 0.3769 | 0.1108 |
| d28 | 5.0289 | 0.5293 | 0.2199 |
| d29 | 5.0104 | 0.6825 | 0.3282 |
| d30 | 4.9877 | 0.8326 | 0.4413 |
| d31 | 4.9607 | 0.9805 | 0.5579 |
| d32 | 4.9297 | 1.1260 | 0.6781 |
| d33 | 4.8950 | 1.2685 | 0.8025 |
| d34 | 4.8567 | 1.4079 | 0.9311 |
| d35 | 4.8364 | 1.4761 | 0.9974 |
| d36 | 4.8259 | 1.5102 | 1.0306 |
| d37 | 4.8205 | 1.5272 | 1.0472 |
| d38 | 4.8178 | 1.5357 | 1.0555 |
| d39 | 4.8151 | 1.5442 | 1.0639 |
| d40 | 4.8147 | 1.5454 | 1.0650 |
| d41 | 4.8145 | 1.5461 | 1.0656 |
| d42 | 4.8144 | 1.5464 | 1.0659 |
| d43 | 4.8143 | 1.5466 | 1.0660 |
| d44 | 4.8143 | 1.5467 | 1.0661 |
| d45 | 4.8143 | 1.5467 | 1.0661 |
| d46 | 4.8143 | 1.5468 | 1.0661 |
| d47 | 4.8143 | 1.5468 | 1.0661 |
| d48 | 4.8143 | 1.5468 | 1.0661 |
| d49 | 4.8143 | 1.5468 | 1.0661 |
| d50 | 4.8143 | 1.5468 | 1.0661 |
| d51 | 4.8143 | 1.5468 | 1.0660 |
| d52 | 4.8143 | 1.5468 | 1.0660 |
| d53 | 4.8143 | 1.5468 | 1.0660 |
| d54 | 4.8143 | 1.5468 | 1.0659 |
| d55 | 4.8143 | 1.5467 | 1.0657 |
| d56 | 4.8144 | 1.5464 | 1.0653 |
| d57 | 4.8146 | 1.5459 | 1.0646 |
| d58 | 4.8149 | 1.5449 | 1.0632 |
| d59 | 4.8172 | 1.5376 | 1.0537 |
| d60 | 4.8196 | 1.5303 | 1.0443 |
| d61 | 4.8242 | 1.5156 | 1.0254 |
| d62 | 4.8333 | 1.4863 | 0.9875 |
| d63 | 4.8510 | 1.4274 | 0.9117 |
| d64 | 4.8851 | 1.3061 | 0.7635 |

TABLE 2-continued

Cross-sectional Coordinates for Blade 28

| Coordinate # | X | Y | Z |
|---|---|---|---|
| d65 | 4.9168 | 1.1812 | 0.6187 |
| d66 | 4.9459 | 1.0524 | 0.4773 |
| d67 | 4.9724 | 0.9195 | 0.3397 |
| d68 | 4.9958 | 0.7823 | 0.2062 |
| d69 | 5.0161 | 0.6395 | 0.0791 |
| d70 | 5.0324 | 0.4948 | −0.0471 |
| d71 | 5.0450 | 0.3433 | −0.1645 |
| d72 | 5.0531 | 0.1898 | −0.2802 |
| d73 | 5.0566 | 0.0295 | −0.3864 |
| d74 | 5.0549 | −0.1322 | −0.4905 |
| d75 | 5.0478 | −0.3000 | −0.5853 |
| d76 | 5.0349 | −0.4683 | −0.6782 |
| d77 | 5.0159 | −0.6407 | −0.7636 |
| d78 | 4.9905 | −0.8155 | −0.8430 |
| d79 | 4.9583 | −0.9925 | −0.9162 |
| d80 | 4.9190 | −1.1717 | −0.9822 |
| d81 | 4.8966 | −1.2621 | −1.0120 |
| d82 | 4.8723 | −1.3531 | −1.0391 |
| d83 | 4.8459 | −1.4448 | −1.0634 |
| d84 | 4.8316 | −1.4918 | −1.0717 |
| d85 | 4.8256 | −1.5113 | −1.0731 |
| d86 | 4.8224 | −1.5212 | −1.0731 |
| d87 | 4.8192 | −1.5313 | −1.0729 |
| d88 | 4.8174 | −1.5369 | −1.0708 |
| d89 | 4.8164 | −1.5401 | −1.0691 |
| d90 | 4.8159 | −1.5418 | −1.0676 |
| d91 | 4.8155 | −1.5428 | −1.0665 |
| d92 | 4.8154 | −1.5435 | −1.0657 |
| d93 | 4.8152 | −1.5438 | −1.0651 |
| d94 | 4.8152 | −1.5441 | −1.0646 |
| d95 | 4.8151 | −1.5442 | −1.0643 |
| d96 | 4.8150 | −1.5445 | −1.0635 |
| e1 | 5.5100 | −1.6166 | −0.9825 |
| e2 | 5.5099 | −1.6168 | −0.9817 |
| e3 | 5.5099 | −1.6169 | −0.9813 |
| e4 | 5.5099 | −1.6170 | −0.9808 |
| e5 | 5.5098 | −1.6171 | −0.9801 |
| e6 | 5.5098 | −1.6171 | −0.9790 |
| e7 | 5.5099 | −1.6169 | −0.9775 |
| e8 | 5.5100 | −1.6164 | −0.9752 |
| e9 | 5.5104 | −1.6150 | −0.9717 |
| e10 | 5.5114 | −1.6116 | −0.9564 |
| e11 | 5.5137 | −1.6038 | −0.9597 |
| e12 | 5.5160 | −1.5959 | −0.9531 |
| e13 | 5.5206 | −1.5797 | −0.9415 |
| e14 | 5.5324 | −1.5380 | −0.9169 |
| e15 | 5.5554 | −1.4527 | −0.8741 |
| e16 | 5.5771 | −1.3672 | −0.8324 |
| e17 | 5.5974 | −1.2816 | −0.7913 |
| e18 | 5.6338 | −1.1106 | −0.7100 |
| e19 | 5.6647 | −0.9401 | −0.6282 |
| e20 | 5.6903 | −0.7706 | −0.5450 |
| e21 | 5.7106 | −0.6021 | −0.4601 |
| e22 | 5.7257 | −0.4359 | −0.3713 |
| e23 | 5.7359 | −0.2686 | −0.2844 |
| e24 | 5.7413 | −0.1048 | −0.1915 |
| e25 | 5.7419 | 0.0604 | −0.1008 |
| e26 | 5.7379 | 0.2223 | −0.0043 |
| e27 | 5.7293 | 0.3855 | 0.0904 |
| e28 | 5.7163 | 0.5450 | 0.1917 |
| e29 | 5.6987 | 0.7054 | 0.2920 |
| e30 | 5.6770 | 0.8630 | 0.3974 |
| e31 | 5.6511 | 1.0186 | 0.5062 |
| e32 | 5.6213 | 1.1721 | 0.6189 |
| e33 | 5.5877 | 1.3230 | 0.7359 |
| e34 | 5.5506 | 1.4711 | 0.8572 |
| e35 | 5.5308 | 1.5438 | 0.9200 |
| e36 | 5.5206 | 1.5801 | 0.9514 |
| e37 | 5.5153 | 1.5982 | 0.9671 |
| e38 | 5.5127 | 1.6072 | 0.9750 |
| e39 | 5.5101 | 1.6163 | 0.9829 |
| e40 | 5.5097 | 1.6176 | 0.9840 |
| e41 | 5.5095 | 1.6183 | 0.9845 |
| e42 | 5.5094 | 1.6187 | 0.9848 |
| e43 | 5.5093 | 1.6189 | 0.9849 |

TABLE 2-continued

Cross-sectional Coordinates for Blade 28

| Coordinate # | X | Y | Z |
|---|---|---|---|
| e44 | 5.5093 | 1.6190 | 0.9849 |
| e45 | 5.5093 | 1.6190 | 0.9850 |
| e46 | 5.5092 | 1.6190 | 0.9850 |
| e47 | 5.5092 | 1.6191 | 0.9850 |
| e48 | 5.5092 | 1.6191 | 0.9850 |
| e49 | 5.5092 | 1.6191 | 0.9850 |
| e50 | 5.5092 | 1.6191 | 0.9849 |
| e51 | 5.5092 | 1.6191 | 0.9849 |
| e52 | 5.5092 | 1.6191 | 0.9849 |
| e53 | 5.5092 | 1.6191 | 0.9848 |
| e54 | 5.5093 | 1.6190 | 0.9847 |
| e55 | 5.5093 | 1.6189 | 0.9845 |
| e56 | 5.5094 | 1.6186 | 0.9842 |
| e57 | 5.5095 | 1.6181 | 0.9835 |
| e58 | 5.5099 | 1.6170 | 0.9822 |
| e59 | 5.5122 | 1.6091 | 0.9731 |
| e60 | 5.5145 | 1.6011 | 0.9640 |
| e61 | 5.5191 | 1.5853 | 0.9458 |
| e62 | 5.5281 | 1.5535 | 0.9094 |
| e63 | 5.5456 | 1.4897 | 0.8366 |
| e64 | 5.5791 | 1.3590 | 0.6945 |
| e65 | 5.6101 | 1.2247 | 0.5560 |
| e66 | 5.6384 | 1.0868 | 0.4211 |
| e67 | 5.6639 | 0.9451 | 0.2902 |
| e68 | 5.6863 | 0.7993 | 0.1636 |
| e69 | 5.7055 | 0.6483 | 0.0438 |
| e70 | 5.7208 | 0.4955 | −0.0750 |
| e71 | 5.7324 | 0.3363 | −0.1847 |
| e72 | 5.7395 | 0.1754 | −0.2925 |
| e73 | 5.7422 | 0.0081 | −0.3904 |
| e74 | 5.7400 | −0.1605 | −0.4862 |
| e75 | 5.7325 | −0.3345 | −0.5722 |
| e76 | 5.7196 | −0.5091 | −0.6563 |
| e77 | 5.7009 | −0.6874 | −0.7325 |
| e78 | 5.6763 | −0.8679 | −0.8026 |
| e79 | 5.6453 | −1.0505 | −0.8661 |
| e80 | 5.6079 | −1.2349 | −0.9223 |
| e81 | 5.5866 | −1.3279 | −0.9470 |
| e82 | 5.5635 | −1.4214 | −0.9691 |
| e83 | 5.5386 | −1.5155 | −0.9882 |
| e84 | 5.5252 | −1.5636 | −0.9938 |
| e85 | 5.5196 | −1.5834 | −0.9941 |
| e86 | 5.5167 | −1.5935 | −0.9935 |
| e87 | 5.5137 | −1.6037 | −0.9927 |
| e88 | 5.5121 | −1.6093 | −0.9903 |
| e89 | 5.5112 | −1.6124 | −0.9883 |
| e90 | 5.5107 | −1.6141 | −0.9868 |
| e91 | 5.5104 | −1.6151 | −0.9856 |
| e92 | 5.5102 | −1.6157 | −0.9847 |
| e93 | 5.5101 | −1.6160 | −0.9841 |
| e94 | 5.5101 | −1.6162 | −0.9836 |
| e95 | 5.5100 | −1.6164 | −0.9833 |
| e96 | 5.5100 | −1.6166 | −0.9825 |
| f1 | 6.2084 | −1.6649 | −0.9026 |
| f2 | 6.2084 | −1.6651 | −0.9017 |
| f3 | 6.2083 | −1.6652 | −0.9014 |
| f4 | 6.2083 | −1.6652 | −0.9008 |
| f5 | 6.2083 | −1.6653 | −0.9001 |
| f6 | 6.2083 | −1.6652 | −0.8991 |
| f7 | 6.2084 | −1.6650 | −0.8975 |
| f8 | 6.2086 | −1.6643 | −0.8953 |
| f9 | 6.2090 | −1.6628 | −0.8919 |
| f10 | 6.2100 | −1.6592 | −0.8867 |
| f11 | 6.2121 | −1.6510 | −0.8804 |
| f12 | 6.2143 | −1.6428 | −0.8742 |
| f13 | 6.2187 | −1.6259 | −0.8635 |
| f14 | 6.2298 | −1.5828 | −0.8410 |
| f15 | 6.2515 | −1.4952 | −0.8025 |
| f16 | 6.2718 | −1.4074 | −0.7650 |
| f17 | 6.2909 | −1.3196 | −0.7283 |
| f18 | 6.3251 | −1.1443 | −0.6554 |
| f19 | 6.3542 | −0.9698 | −0.5820 |
| f20 | 6.3783 | −0.7962 | −0.5072 |
| f21 | 6.3975 | −0.6236 | −0.4306 |
| f22 | 6.4118 | −0.4533 | −0.3499 |

TABLE 2-continued

Cross-sectional Coordinates for Blade 28

| Coordinate # | X | Y | Z |
|---|---|---|---|
| f23 | 6.4216 | −0.2819 | −0.2711 |
| f24 | 6.4268 | −0.1138 | −0.1863 |
| f25 | 6.4275 | 0.0555 | −0.1036 |
| f26 | 6.4239 | 0.2219 | −0.0150 |
| f27 | 6.4160 | 0.3894 | 0.0718 |
| f28 | 6.4039 | 0.5538 | 0.1652 |
| f29 | 6.3874 | 0.7189 | 0.2576 |
| f30 | 6.3670 | 0.8816 | 0.3552 |
| f31 | 6.3427 | 1.0426 | 0.4564 |
| f32 | 6.3144 | 1.2017 | 0.5615 |
| f33 | 6.2826 | 1.3585 | 0.6709 |
| f34 | 6.2472 | 1.5128 | 0.7847 |
| f35 | 6.2283 | 1.5888 | 0.8437 |
| f36 | 6.2185 | 1.6267 | 0.8733 |
| f37 | 6.2135 | 1.6457 | 0.8881 |
| f38 | 6.2110 | 1.6552 | 0.8955 |
| f39 | 6.2085 | 1.6646 | 0.9029 |
| f40 | 6.2081 | 1.6660 | 0.9040 |
| f41 | 6.2079 | 1.6667 | 0.9045 |
| f42 | 6.2078 | 1.6671 | 0.9047 |
| f43 | 6.2078 | 1.6673 | 0.9048 |
| f44 | 6.2077 | 1.6674 | 0.9049 |
| f45 | 6.2077 | 1.6674 | 0.9049 |
| f46 | 6.2077 | 1.6675 | 0.9049 |
| f47 | 6.2077 | 1.6675 | 0.9049 |
| f48 | 6.2077 | 1.6675 | 0.9049 |
| f49 | 6.2077 | 1.6675 | 0.9049 |
| f50 | 6.2077 | 1.6675 | 0.9049 |
| f51 | 6.2077 | 1.6675 | 0.9048 |
| f52 | 6.2077 | 1.6675 | 0.9048 |
| f53 | 6.2077 | 1.6675 | 0.9047 |
| f54 | 6.2077 | 1.6674 | 0.9046 |
| f55 | 6.2078 | 1.6673 | 0.9045 |
| f56 | 6.2078 | 1.6670 | 0.9041 |
| f57 | 6.2080 | 1.6665 | 0.9035 |
| f58 | 6.2083 | 1.6653 | 0.9022 |
| f59 | 6.2106 | 1.6569 | 0.8935 |
| f60 | 6.2128 | 1.6485 | 0.8848 |
| f61 | 6.2172 | 1.6317 | 0.8675 |
| f62 | 6.2259 | 1.5981 | 0.8327 |
| f63 | 6.2429 | 1.5306 | 0.7631 |
| f64 | 6.2751 | 1.3927 | 0.6277 |
| f65 | 6.3048 | 1.2514 | 0.4960 |
| f66 | 6.3318 | 1.1068 | 0.3680 |
| f67 | 6.3559 | 0.9586 | 0.2442 |
| f68 | 6.3770 | 0.8067 | 0.1249 |
| f69 | 6.3948 | 0.6499 | 0.0125 |
| f70 | 6.4090 | 0.4914 | −0.0988 |
| f71 | 6.4195 | 0.3271 | −0.2006 |
| f72 | 6.4258 | 0.1611 | −0.3006 |
| f73 | 6.4278 | −0.0107 | −0.3904 |
| f74 | 6.4252 | −0.1836 | −0.4779 |
| f75 | 6.4176 | −0.3617 | −0.5554 |
| f76 | 6.4050 | −0.5401 | −0.6310 |
| f77 | 6.3871 | −0.7219 | −0.6985 |
| f78 | 6.3636 | −0.9058 | −0.7597 |
| f79 | 6.3344 | −1.0915 | −0.8143 |
| f80 | 6.2992 | −1.2790 | −0.8613 |
| f81 | 6.2793 | −1.3734 | −0.8815 |
| f82 | 6.2578 | −1.4682 | −0.8989 |
| f83 | 6.2347 | −1.5636 | −0.9133 |
| f84 | 6.2223 | −1.6122 | −0.9165 |
| f85 | 6.2171 | −1.6321 | −0.9158 |
| f86 | 6.2145 | −1.6422 | −0.9147 |
| f87 | 6.2118 | −1.6524 | −0.9134 |
| f88 | 6.2103 | −1.6580 | −0.9107 |
| f89 | 6.2095 | −1.6610 | −0.9086 |
| f90 | 6.2090 | −1.6626 | −0.9070 |
| f91 | 6.2088 | −1.6635 | −0.9057 |
| f92 | 6.2086 | −1.6641 | −0.9048 |
| f93 | 6.2086 | −1.6644 | −0.9042 |
| f94 | 6.2085 | −1.6646 | −0.9037 |
| f95 | 6.2085 | −1.6647 | −0.9034 |
| f96 | 6.2084 | −1.6649 | −0.9026 |
| g1 | 6.9092 | −1.6919 | −0.8225 |

TABLE 2-continued

Cross-sectional Coordinates for Blade 28

| Coordinate # | X | Y | Z |
|---|---|---|---|
| g2 | 6.9092 | −1.6921 | −0.8216 |
| g3 | 6.9091 | −1.6921 | −0.8213 |
| g4 | 6.9091 | −1.6921 | −0.8208 |
| g5 | 6.9091 | −1.6921 | −0.8200 |
| g6 | 6.9092 | −1.6921 | −0.8190 |
| g7 | 6.9092 | −1.6918 | −0.8175 |
| g8 | 6.9094 | −1.6910 | −0.8153 |
| g9 | 6.9098 | −1.6893 | −0.8120 |
| g10 | 6.9108 | −1.6855 | −0.8070 |
| g11 | 6.9128 | −1.6771 | −0.8011 |
| g12 | 6.9148 | −1.6687 | −0.7953 |
| g13 | 6.9190 | −1.6514 | −0.7854 |
| g14 | 6.9293 | −1.6076 | −0.7651 |
| g15 | 6.9493 | −1.5186 | −0.7308 |
| g16 | 6.9682 | −1.4297 | −0.6975 |
| g17 | 6.9858 | −1.3408 | −0.6649 |
| g18 | 7.0175 | −1.1634 | −0.6004 |
| g19 | 7.0445 | −0.9869 | −0.5352 |
| g20 | 7.0669 | −0.8113 | −0.4686 |
| g21 | 7.0848 | −0.6368 | −0.4001 |
| g22 | 7.0982 | −0.4644 | −0.3274 |
| g23 | 7.1074 | −0.2912 | −0.2567 |
| g24 | 7.1123 | −0.1209 | −0.1798 |
| g25 | 7.1132 | 0.0506 | −0.1051 |
| g26 | 7.1100 | 0.2193 | −0.0244 |
| g27 | 7.1027 | 0.3892 | 0.0544 |
| g28 | 7.0916 | 0.5562 | 0.1400 |
| g29 | 7.0764 | 0.7240 | 0.2245 |
| g30 | 7.0575 | 0.8896 | 0.3142 |
| g31 | 7.0348 | 1.0539 | 0.4075 |
| g32 | 7.0085 | 1.2164 | 0.5047 |
| g33 | 6.9788 | 1.3770 | 0.6063 |
| g34 | 6.9456 | 1.5354 | 0.7123 |
| g35 | 6.9279 | 1.6136 | 0.7675 |
| g36 | 6.9187 | 1.6526 | 0.7952 |
| g37 | 6.9140 | 1.6721 | 0.8090 |
| g38 | 6.9116 | 1.6819 | 0.8159 |
| g39 | 6.9093 | 1.6916 | 0.8228 |
| g40 | 6.9089 | 1.6931 | 0.8238 |
| g41 | 6.9087 | 1.6938 | 0.8243 |
| g42 | 8.9086 | 1.6942 | 0.8245 |
| g43 | 6.9086 | 1.6944 | 0.8246 |
| g44 | 6.9086 | 1.6945 | 0.8247 |
| g45 | 6.9085 | 1.6945 | 0.8247 |
| g46 | 6.9085 | 1.6946 | 0.8247 |
| g47 | 6.9085 | 1.6946 | 0.8247 |
| g48 | 6.9085 | 1.6946 | 0.8247 |
| g49 | 6.9085 | 1.6946 | 0.8247 |
| g50 | 6.9085 | 1.6946 | 0.8246 |
| g51 | 6.9085 | 1.6946 | 0.8246 |
| g52 | 6.9085 | 1.6946 | 0.8246 |
| g53 | 6.9085 | 1.6946 | 0.8245 |
| g54 | 6.9086 | 1.6945 | 0.8244 |
| g55 | 6.9086 | 1.6944 | 0.8242 |
| g56 | 6.9087 | 1.6941 | 0.8239 |
| g57 | 6.9088 | 1.6935 | 0.8233 |
| g58 | 6.9091 | 1.6922 | 0.8221 |
| g59 | 6.9112 | 1.6835 | 0.8138 |
| g60 | 6.9134 | 1.6748 | 0.8056 |
| g61 | 6.9176 | 1.6574 | 0.7891 |
| g62 | 6.9258 | 1.6224 | 0.7562 |
| g63 | 6.9419 | 1.5523 | 0.6902 |
| g64 | 6.9723 | 1.4092 | 0.5620 |
| g65 | 7.0003 | 1.2631 | 0.4376 |
| g66 | 7.0256 | 1.1139 | 0.3170 |
| g67 | 7.0481 | 0.9614 | 0.2007 |
| g68 | 7.0676 | 0.8055 | 0.0891 |
| g69 | 7.0840 | 0.6450 | −0.0155 |
| g70 | 7.0969 | 0.4831 | −0.1191 |
| g71 | 7.1063 | 0.3157 | −0.2129 |
| g72 | 7.1118 | 0.1468 | −0.3049 |
| g73 | 7.1133 | −0.0274 | −0.3865 |
| g74 | 7.1104 | −0.2026 | −0.4659 |
| g75 | 7.1030 | −0.3824 | −0.5351 |
| g76 | 7.0911 | −0.5626 | −0.6023 |

TABLE 2-continued

Cross-sectional Coordinates for Blade 28

| Coordinate # | X | Y | Z |
|---|---|---|---|
| g77 | 7.0741 | −0.7458 | −0.6614 |
| g78 | 7.0522 | −0.9309 | −0.7141 |
| g79 | 7.0250 | −1.1177 | −0.7602 |
| g80 | 6.9924 | −1.3060 | −0.7986 |
| g81 | 6.9741 | −1.4007 | −0.8145 |
| g82 | 6.9543 | −1.4958 | −0.8276 |
| g83 | 6.9330 | −1.5914 | −0.8376 |
| g84 | 6.9217 | −1.6399 | −0.8386 |
| g85 | 6.9170 | −1.6597 | −0.8370 |
| g86 | 6.9146 | −1.6698 | −0.8355 |
| g87 | 6.9121 | −1.6799 | −0.8337 |
| g88 | 6.9108 | −1.6853 | −0.8309 |
| g89 | 6.9101 | −1.6882 | −0.8286 |
| g90 | 6.9097 | −1.6898 | −0.8269 |
| g91 | 6.9095 | −1.6907 | −0.8257 |
| g92 | 6.9094 | −1.6912 | −0.8248 |
| g93 | 6.9093 | −1.6914 | −0.8241 |
| g94 | 6.9093 | −1.6916 | −0.8236 |
| g95 | 6.9092 | −1.6917 | −0.8233 |
| g96 | 6.9092 | −1.6919 | −0.8225 |
| h1 | 7.6115 | −1.6995 | −0.7407 |
| h2 | 7.6114 | −1.6996 | −0.7399 |
| h3 | 7.6114 | −1.6996 | −0.7395 |
| h4 | 7.6114 | −1.6996 | −0.7390 |
| h5 | 7.6114 | −1.6996 | −0.7383 |
| h6 | 7.6115 | −1.6995 | −0.7373 |
| h7 | 7.6116 | −1.6991 | −0.7358 |
| h8 | 7.6117 | −1.6983 | −0.7337 |
| h9 | 7.6121 | −1.6965 | −0.7305 |
| h10 | 7.6130 | −1.6925 | −0.7258 |
| h11 | 7.6149 | −1.6840 | −0.7203 |
| h12 | 7.6168 | −1.6754 | −0.7150 |
| h13 | 7.6206 | −1.6580 | −0.7060 |
| h14 | 7.6301 | −1.6138 | −0.6877 |
| h15 | 7.6484 | −1.5246 | −0.6576 |
| h16 | 7.6656 | −1.4355 | −0.6285 |
| h17 | 7.6818 | −1.3465 | −0.6001 |
| h18 | 7.7108 | −1.1691 | −0.5438 |
| h19 | 7.7355 | −0.9925 | −0.4869 |
| h20 | 7.7560 | −0.8170 | −0.4284 |
| h21 | 7.7724 | −0.6425 | −0.3680 |
| h22 | 7.7847 | −0.4699 | −0.3035 |
| h23 | 7.7932 | −0.2967 | −0.2408 |
| h24 | 7.7979 | −0.1261 | −0.1720 |
| h25 | 7.7988 | 0.0456 | −0.1054 |
| h26 | 7.7959 | 0.2147 | −0.0327 |
| h27 | 7.7894 | 0.3850 | 0.0380 |
| h28 | 7.7793 | 0.5527 | 0.1155 |
| h29 | 7.7655 | 0.7213 | 0.1918 |
| h30 | 7.7482 | 0.8880 | 0.2734 |
| h31 | 7.7274 | 1.0535 | 0.3586 |
| h32 | 7.7033 | 1.2176 | 0.4476 |
| h33 | 7.6758 | 1.3800 | 0.5410 |
| h34 | 7.6452 | 1.5405 | 0.6388 |
| h35 | 7.6288 | 1.6199 | 0.6899 |
| h36 | 7.6203 | 1.6595 | 0.7155 |
| h37 | 7.6159 | 1.6794 | 0.7283 |
| h38 | 7.6137 | 1.6893 | 0.7347 |
| h39 | 7.6115 | 1.6992 | 0.7411 |
| h40 | 7.6112 | 1.7006 | 0.7420 |
| h41 | 7.6110 | 1.7014 | 0.7424 |
| h42 | 7.6110 | 1.7018 | 0.7426 |
| h43 | 7.6109 | 1.7020 | 0.7427 |
| h44 | 7.6109 | 1.7021 | 0.7428 |
| h45 | 7.6109 | 1.7021 | 0.7428 |
| h46 | 7.6109 | 1.7021 | 0.7428 |
| h47 | 7.6109 | 1.7022 | 0.7428 |
| h48 | 7.6109 | 1.7022 | 0.7428 |
| h49 | 7.6109 | 1.7022 | 0.7428 |
| h50 | 7.6109 | 1.7022 | 0.7427 |
| h51 | 7.6109 | 1.7022 | 0.7427 |
| h52 | 7.6109 | 1.7022 | 0.7427 |
| h53 | 7.6109 | 1.7022 | 0.7426 |
| h54 | 7.6109 | 1.7021 | 0.7425 |
| h55 | 7.6109 | 1.7020 | 0.7424 |

TABLE 2-continued

Cross-sectional Coordinates for Blade 28

| Coordinate # | X | Y | Z |
|---|---|---|---|
| h56 | 7.6110 | 1.7017 | 0.7421 |
| h57 | 7.6111 | 1.7010 | 0.7415 |
| h58 | 7.6114 | 1.6997 | 0.7403 |
| h59 | 7.6134 | 1.6908 | 0.7326 |
| h60 | 7.6154 | 1.6819 | 0.7248 |
| h61 | 7.6193 | 1.6640 | 0.7094 |
| h62 | 7.6270 | 1.6282 | 0.6784 |
| h63 | 7.6420 | 1.5563 | 0.6163 |
| h64 | 7.6704 | 1.4100 | 0.4961 |
| h65 | 7.6963 | 1.2610 | 0.3797 |
| h66 | 7.7196 | 1.1091 | 0.2671 |
| h67 | 7.7403 | 0.9542 | 0.1589 |
| h68 | 7.7581 | 0.7962 | 0.0554 |
| h69 | 7.7731 | 0.6340 | −0.0411 |
| h70 | 7.7847 | 0.4705 | −0.1364 |
| h71 | 7.7930 | 0.3020 | −0.2221 |
| h72 | 7.7978 | 0.1322 | −0.3058 |
| h73 | 7.7988 | −0.0424 | −0.3791 |
| h74 | 7.7958 | −0.2179 | −0.4502 |
| h75 | 7.7888 | −0.3975 | −0.5110 |
| h76 | 7.7775 | −0.5775 | −0.5699 |
| h77 | 7.7618 | −0.7602 | −0.6207 |
| h78 | 7.7415 | −0.9445 | −0.6651 |
| h79 | 7.7165 | −1.1303 | −0.7029 |
| h80 | 7.6868 | −1.3175 | −0.7330 |
| h81 | 7.6701 | −1.4115 | −0.7448 |
| h82 | 7.6521 | −1.5060 | −0.7538 |
| h83 | 7.6328 | −1.6007 | −0.7597 |
| h84 | 7.6226 | −1.6487 | −0.7587 |
| h85 | 7.6184 | −1.6682 | −0.7564 |
| h86 | 7.6162 | −1.6781 | −0.7544 |
| h87 | 7.6140 | −1.6880 | −0.7523 |
| h88 | 7.6129 | −1.6933 | −0.7492 |
| h89 | 7.6122 | −1.6960 | −0.7469 |
| h90 | 7.6119 | −1.6975 | −0.7452 |
| h91 | 7.6117 | −1.6983 | −0.7439 |
| h92 | 7.6116 | −1.6988 | −0.7430 |
| h93 | 7.6116 | −1.6990 | −0.7423 |
| h94 | 7.6115 | −1.6992 | −0.7419 |
| h95 | 7.6115 | −1.6993 | −0.7415 |
| h96 | 7.6115 | −1.6995 | −0.7407 |
| i1 | 8.3146 | −1.6891 | −0.6550 |
| i2 | 8.3146 | −1.6892 | −0.6541 |
| i3 | 8.3146 | −1.6892 | −0.6538 |
| i4 | 8.3146 | −1.6892 | −0.6533 |
| i5 | 8.3146 | −1.6891 | −0.6526 |
| i6 | 8.3146 | −1.6890 | −0.6516 |
| i7 | 8.3147 | −1.6886 | −0.6502 |
| i8 | 8.3149 | −1.6877 | −0.6481 |
| i9 | 8.3153 | −1.6858 | −0.6451 |
| i10 | 8.3161 | −1.6817 | −0.6407 |
| i11 | 8.3178 | −1.6732 | −0.6357 |
| i12 | 8.3196 | −1.6646 | −0.6308 |
| i13 | 8.3230 | −1.6472 | −0.6227 |
| i14 | 8.3316 | −1.6032 | −0.6067 |
| i15 | 8.3481 | −1.5147 | −0.5810 |
| i16 | 8.3637 | −1.4264 | −0.5562 |
| i17 | 8.3782 | −1.3382 | −0.5320 |
| i18 | 8.4044 | −1.1626 | −0.4842 |
| i19 | 8.4267 | −0.9878 | −0.4357 |
| i20 | 8.4453 | −0.8141 | −0.3856 |
| i21 | 8.4602 | −0.6414 | −0.3336 |
| i22 | 8.4714 | −0.4705 | −0.2775 |
| i23 | 8.4792 | −0.2989 | −0.2232 |
| i24 | 8.4835 | −0.1298 | −0.1628 |
| i25 | 8.4843 | 0.0403 | −0.1046 |
| i26 | 8.4819 | 0.2082 | −0.0404 |
| i27 | 8.4761 | 0.3771 | 0.0219 |
| i28 | 8.4670 | 0.5438 | 0.0908 |
| i29 | 8.4546 | 0.7114 | 0.1586 |
| i30 | 8.4390 | 0.8773 | 0.2316 |
| i31 | 8.4202 | 1.0424 | 0.3081 |
| i32 | 8.3983 | 1.2062 | 0.3884 |
| i33 | 8.3733 | 1.3687 | 0.4730 |
| i34 | 8.3454 | 1.5296 | 0.5620 |

TABLE 2-continued

Cross-sectional Coordinates for Blade 28

| Coordinate # | X | Y | Z |
|---|---|---|---|
| i35 | 8.3304 | 1.6092 | 0.6086 |
| i36 | 8.3226 | 1.6490 | 0.6320 |
| i37 | 8.3187 | 1.6690 | 0.6437 |
| i38 | 8.3167 | 1.6789 | 0.6495 |
| i39 | 8.3147 | 1.6889 | 0.6553 |
| i40 | 8.3144 | 1.6903 | 0.6562 |
| i41 | 8.3142 | 1.6911 | 0.6566 |
| i42 | 8.3141 | 1.6914 | 0.6568 |
| i43 | 8.3141 | 1.6916 | 0.6568 |
| i44 | 8.3141 | 1.6917 | 0.6569 |
| i45 | 8.3141 | 1.6918 | 0.6569 |
| i46 | 8.3141 | 1.6918 | 0.6569 |
| i47 | 8.3141 | 1.6919 | 0.6569 |
| i48 | 8.3140 | 1.6919 | 0.6568 |
| i49 | 8.3140 | 1.6919 | 0.6568 |
| i50 | 8.3140 | 1.6919 | 0.6568 |
| i51 | 8.3140 | 1.6919 | 0.6568 |
| i52 | 8.3140 | 1.6919 | 0.6568 |
| i53 | 8.3141 | 1.6918 | 0.6567 |
| i54 | 8.3141 | 1.6918 | 0.6566 |
| i55 | 8.3141 | 1.6916 | 0.6565 |
| i56 | 8.3142 | 1.6913 | 0.6562 |
| i57 | 8.3143 | 1.6907 | 0.6556 |
| i58 | 8.3146 | 1.6894 | 0.6546 |
| i59 | 8.3164 | 1.6803 | 0.6474 |
| i60 | 8.3182 | 1.6713 | 0.6402 |
| i61 | 8.3218 | 1.6532 | 0.6258 |
| i62 | 8.3290 | 1.6169 | 0.5970 |
| i63 | 8.3428 | 1.5441 | 0.5394 |
| i64 | 8.3688 | 1.3963 | 0.4280 |
| i65 | 8.3925 | 1.2460 | 0.3204 |
| i66 | 8.4137 | 1.0931 | 0.2167 |
| i67 | 8.4325 | 0.9375 | 0.1173 |
| i68 | 8.4486 | 0.7791 | 0.0225 |
| i69 | 8.4620 | 0.6170 | −0.0651 |
| i70 | 8.4723 | 0.4536 | −0.1517 |
| i71 | 8.4796 | 0.2859 | −0.2286 |
| i72 | 8.4836 | 0.1169 | −0.3035 |
| i73 | 8.4843 | −0.0563 | −0.3681 |
| i74 | 8.4813 | −0.2303 | −0.4305 |
| i75 | 8.4746 | −0.4080 | −0.4828 |
| i76 | 8.4642 | −0.5859 | −0.5332 |
| i77 | 8.4498 | −0.7662 | −0.5755 |
| i78 | 8.4313 | −0.9479 | −0.6115 |
| i79 | 8.4087 | −1.1309 | −0.6409 |
| i80 | 8.3819 | −1.3150 | −0.6629 |
| i81 | 8.3669 | −1.4075 | −0.6705 |
| i82 | 8.3508 | −1.5002 | −0.6755 |
| i83 | 8.3335 | −1.5932 | −0.6775 |
| i84 | 8.3244 | −1.6401 | −0.6746 |
| i85 | 8.3206 | −1.6591 | −0.6715 |
| i86 | 8.3187 | −1.6687 | −0.6692 |
| i87 | 8.3168 | −1.6783 | −0.6667 |
| i88 | 8.3158 | −1.6834 | −0.6635 |
| i89 | 8.3152 | −1.6860 | −0.6612 |
| i90 | 8.3150 | −1.6874 | −0.6594 |
| i91 | 8.3148 | −1.6881 | −0.6581 |
| i92 | 8.3147 | −1.6885 | −0.6572 |
| i93 | 8.3147 | −1.6888 | −0.6566 |
| i94 | 8.3146 | −1.6889 | −0.6561 |
| i95 | 8.3146 | −1.6890 | −0.6558 |
| i96 | 8.3146 | −1.6891 | −0.6550 |
| j1 | 9.0182 | −1.6619 | −0.5627 |
| j2 | 9.0181 | −1.6619 | −0.5619 |
| j3 | 9.0182 | −1.6619 | −0.5616 |
| j4 | 9.0182 | −1.6619 | −0.5611 |
| j5 | 9.0182 | −1.6618 | −0.5604 |
| j6 | 9.0182 | −1.6616 | −0.5595 |
| j7 | 9.0183 | −1.6611 | −0.5581 |
| j8 | 9.0185 | −1.6602 | −0.5561 |
| j9 | 9.0188 | −1.6582 | −0.5533 |
| j10 | 9.0196 | −1.6541 | −0.5492 |
| j11 | 9.0211 | −1.6456 | −0.5447 |
| j12 | 9.0227 | −1.6370 | −0.5404 |
| j13 | 9.0258 | −1.6198 | −0.5333 |

TABLE 2-continued

Cross-sectional Coordinates for Blade 28

| Coordinate # | X | Y | Z |
|---|---|---|---|
| j14 | 9.0335 | −1.5766 | −0.5197 |
| j15 | 9.0482 | −1.4897 | −0.4985 |
| j16 | 9.0620 | −1.4031 | −0.4783 |
| j17 | 9.0750 | −1.3167 | −0.4586 |
| j18 | 9.0983 | −1.1445 | −0.4197 |
| j19 | 9.1182 | −0.9734 | −0.3801 |
| j20 | 9.1348 | −0.8032 | −0.3390 |
| j21 | 9.1481 | −0.6340 | −0.2959 |
| j22 | 9.1581 | −0.4663 | −0.2487 |
| j23 | 9.1651 | −0.2982 | −0.2034 |
| j24 | 9.1690 | −0.1322 | −0.1520 |
| j25 | 9.1699 | 0.0346 | −0.1028 |
| j26 | 9.1678 | 0.1996 | −0.0477 |
| j27 | 9.1627 | 0.3655 | 0.0055 |
| j28 | 9.1547 | 0.5296 | 0.0652 |
| j29 | 9.1437 | 0.6944 | 0.1238 |
| j30 | 9.1298 | 0.8580 | 0.1875 |
| j31 | 9.1130 | 1.0209 | 0.2545 |
| j32 | 9.0934 | 1.1829 | 0.3253 |
| j33 | 9.0710 | 1.3437 | 0.4003 |
| j34 | 9.0459 | 1.5033 | 0.4795 |
| j35 | 9.0324 | 1.5825 | 0.5213 |
| j36 | 9.0254 | 1.6220 | 0.5422 |
| j37 | 9.0218 | 1.6418 | 0.5526 |
| j38 | 9.0200 | 1.6517 | 0.5578 |
| j39 | 9.0182 | 1.6616 | 0.5631 |
| j40 | 9.0179 | 1.6631 | 0.5638 |
| j41 | 9.0178 | 1.6638 | 0.5642 |
| j42 | 9.0177 | 1.6642 | 0.5643 |
| j43 | 9.0177 | 1.6644 | 0.5644 |
| j44 | 9.0177 | 1.6645 | 0.5644 |
| j45 | 9.0177 | 1.6645 | 0.5644 |
| j46 | 9.0177 | 1.6646 | 0.5644 |
| j47 | 9.0177 | 1.6646 | 0.5644 |
| j48 | 9.0176 | 1.6646 | 0.5644 |
| j49 | 9.0176 | 1.6646 | 0.5644 |
| j50 | 9.0176 | 1.6646 | 0.5644 |
| j51 | 9.0176 | 1.6646 | 0.5644 |
| j52 | 9.0177 | 1.6646 | 0.5643 |
| j53 | 9.0177 | 1.6646 | 0.5643 |
| j54 | 9.0177 | 1.6645 | 0.5642 |
| j55 | 9.0177 | 1.6643 | 0.5640 |
| j56 | 9.0178 | 1.6640 | 0.5638 |
| j57 | 9.0179 | 1.6634 | 0.5633 |
| j58 | 9.0181 | 1.6621 | 0.5623 |
| j59 | 9.0198 | 1.6530 | 0.5557 |
| j60 | 9.0214 | 1.6439 | 0.5492 |
| j61 | 9.0247 | 1.6258 | 0.5360 |
| j62 | 9.0312 | 1.5894 | 0.5097 |
| j63 | 9.0437 | 1.5165 | 0.4571 |
| j64 | 9.0673 | 1.3687 | 0.3556 |
| j65 | 9.0887 | 1.2186 | 0.2579 |
| j66 | 9.1078 | 1.0663 | 0.1640 |
| j67 | 9.1246 | 0.9116 | 0.0744 |
| j68 | 9.1389 | 0.7543 | −0.0106 |
| j69 | 9.1507 | 0.5939 | −0.0886 |
| j70 | 9.1598 | 0.4323 | −0.1654 |
| j71 | 9.1661 | 0.2669 | −0.2328 |
| j72 | 9.1694 | 0.1004 | −0.2983 |
| j73 | 9.1697 | −0.0697 | −0.3536 |
| j74 | 9.1668 | −0.2405 | −0.4067 |
| j75 | 9.1606 | −0.4144 | −0.4498 |
| j76 | 9.1511 | −0.5886 | −0.4911 |
| j77 | 9.1381 | −0.7647 | −0.5245 |
| j78 | 9.1215 | −0.9420 | −0.5518 |
| j79 | 9.1013 | −1.1203 | −0.5726 |
| j80 | 9.0775 | −1.2995 | −0.5861 |
| j81 | 9.0641 | −1.3894 | −0.5896 |
| j82 | 9.0499 | −1.4795 | −0.5905 |
| j83 | 9.0347 | −1.5697 | −0.5885 |
| j84 | 9.0266 | −1.6151 | −0.5837 |
| j85 | 9.0233 | −1.6334 | −0.5800 |
| j86 | 9.0217 | −1.6426 | −0.5773 |
| j87 | 9.0200 | −1.6519 | −0.5745 |
| j88 | 9.0191 | −1.6566 | −0.5712 |

TABLE 2-continued

Cross-sectional Coordinates for Blade 28

| Coordinate # | X | Y | Z |
|---|---|---|---|
| j89 | 9.0187 | −1.6591 | −0.5688 |
| j90 | 9.0184 | −1.6604 | −0.5671 |
| j91 | 9.0183 | −1.6610 | −0.5658 |
| j92 | 9.0182 | −1.6614 | −0.5649 |
| j93 | 9.0182 | −1.6616 | −0.5643 |
| j94 | 9.0182 | −1.6617 | −0.5638 |
| j95 | 9.0182 | −1.6618 | −0.5635 |
| j96 | 9.0182 | −1.6619 | −0.5627 |

Although the plurality of coordinates in TABLE 2 correspond to a blade having a nine inch tip radius, (i.e., a fan having an eighteen inch propeller diameter), the TABLE 2 coordinates could simply be scaled up or down by a fixed percentage in order to correspond to a blade having a larger or smaller propeller diameter. For example, for a fan having a thirty inch propeller diameter, the blade (having a fifteen inch tip radius) would have an external surface having a shape defined by the relative positioning of the plurality of coordinates listed in TABLE 2 scaled up by a factor of ⅔ or a fixed percentage of 166.67%.

The inventive blade design embodied in the propeller 14 provides increased performance, including improved efficiency and decreased noise levels. The illustrated propeller 14, when operated under the parameters used to generate TABLE 1 discussed above (e.g., 1800 rpm, 0.05 static pressure, etc.) provided a 5–10 percent performance increase and a 2–3 decibel reduction in noise levels. It is believed that when the inventive blade design is combined with the inventive cylinder and drive assembly designs described in detail below, the improved efficiency of the fan 10 can approach as much as 20 percent and the noise level reduction can approach as much as 6 decibels.

The drive assembly 16 rotatably supports the propeller 14 in the cylinder 12 and is operable to rotate the propeller 14. As shown in FIG. 5, the drive assembly includes a shaft 66 fixed relative to the hub 26 and extending axially therefrom along the rotational axis $A_R$. The shaft 66 is fixed relative to the hub 26 by a bushing 68 keyed to the shaft 66 by a key 70. The portion of the shaft 66 that is distal to the hub 26 is encased by a bearing cover 72. The bearing cover 72 includes a top plate 74 that is fixed relative to the cylinder 12 by a belt cover 76. The top plate 74 of the bearing cover 72 is fixed to (e.g., weldment, etc.) the bottom portion (i.e., the portion distal to the interior surface 18 of the cylinder 12) of the belt cover 76 and the top portion of the belt cover 76 is fixed (e.g., weldment, etc.) to the cylinder 12. The shaft 66 is supported on the top plate 74 of the bearing cover 72 by a pair of pillow block bearings 78 and 80. A sheave 82 is keyed to the distal end of the shaft 66 by a key 84. The top plate 74 includes a semi-circular shaped aperture 86 that the sheave 82 projects through and that is configured to be enclosed within the belt cover 76 (see FIG. 6). The bearing cover 72 further includes a lower casement comprising a bottom wall 88 extending generally parallel to the top plate 74, a pair of sidewalls 88*a* and 88*b* extending generally perpendicular to the bottom wall 88 and the top plate 74, and a pair of converging walls 88*c*, 88*d* extending generally non-parallel and non-perpendicular to the bottom wall 88 and the top plate 74. The bearing cover 72 further includes end panels 90 and 92. For assembly purposes, the walls 88, 88*a*, 88*b*, 88*c*, 88*d* include end tabs that fold over the end panels 90, 92 (see FIGS. 2 and 4) for facilitating fixing the panels 90,92 to the casement (e.g., spot welding, etc.). The end panel 90 is slotted to provide adequate clearance for the shaft 66. The casement is fixed to the top plate 74 by a pair of bracket assemblies 94 and 96 (see FIG. 5).

When the propeller 14 rotates, air is drawn through the cylinder 12. In some applications, this air will be polluted with particles (e.g., exhausting a spray booth). Certain such particles can undesirably interfere with the efficient operation of certain components of the drive assembly (e.g., the bearings 78 and 80). It is therefore important that the bearing cover 72 present a solid surface portion that is in an upstream covering relationship with the bearings 78 and 80 to obstruct airflow through the bearing cover 72. In the illustrated bearing cover 72, the end panel 92 functions as the solid surface obstructing air flow through the bearing cover 72. However, it is also important that the bearing cover has aerodynamic qualities. For example, it is believed that the shape of the illustrated bearing cover 72 (e.g., having the convergent walled design) enhances its aerodynamic qualities. Particularly, it is important that the airflow-obstructing solid surface have a minimized surface area. It is further preferred that this surface area is representative of a generally uniform cross-section of the cover 72 along its length. It is believed that minimizing this surface area facilitates maximizing the flow output of the fan 10. In this regard, the bearing cover 72 presents a cover dimension $D_C$ (see FIG. 5) from the rotational axis $A_R$ to the radially lowermost wall of the casement 88 of the bearing cover 72. The cover dimension $D_C$ is preferably less than about one-sixth the propeller diameter $\phi$ (or less than about one-third the tip radius $R_T$). As previously indicated, the illustrated blade 28 has a tip radius $R_T$ of nine inches and a propeller diameter $\phi$ of eighteen inches. In the illustrated bearing cover 72, the cover dimension $D_C$ is approximately two inches and thus only about one-ninth of the propeller diameter $\phi$. However, for fans having a larger propeller diameter, the bearing cover is typically also larger. For example, a fan having a propeller diameter of sixty inches typically requires a bearing cover having a cover dimension of about eight inches, which is less than one-sixth of the propeller diameter. Those skilled in the art will appreciate that while the cover dimension $D_C$ does not measure the actual height of the bearing cover 72, the preferred limitation of one-sixth the propeller diameter $\phi$ is directed in part to limiting the height of the bearing cover 72. However, it is further believed that the other dimensions relevant to the area of the flow-obstructing surface of the bearing cover 72 (e.g., its width) should also be minimized as much as possible to enhance the overall aerodynamic qualities of the cover 72.

The shaft 66 is drivingly connected to a power source 98 by an endless belt 100. As shown in FIG. 5, the belt 100 entrains the sheave 82 and extends up through and out of the belt cover 76 where it entrains a drive pulley 102 coupled to an output shaft 104 of the power source 98. The power source 98 is bolted to a motor mount 106 that is adjustably bracketed to motor support 108 by a bracket assembly 110. The motor support 108 is fixed to (e.g., weldment, etc.) the top of the cylinder 12. The belt cover 76 encircles the portion of the belt 100 extending between the top plate 74 of the bearing cover 72 and the top of the cylinder 12.

Figure 6:
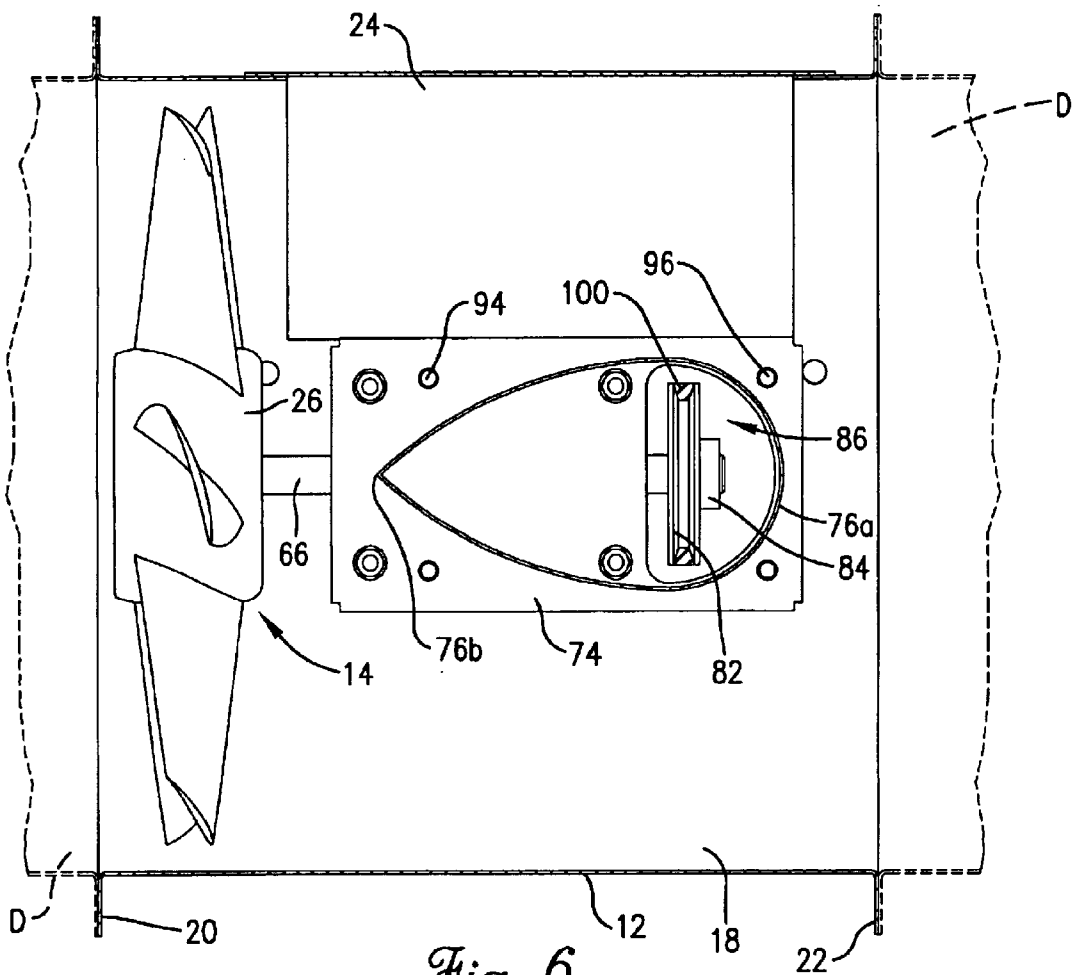
FIG. 6 is a sectional view of the tubeaxial fan taken substantially along line 6—6 of FIG. 5 and shown in combination with duct work (in phantom)

The majority of the belt cover 76 is located within the cylinder 12 and therefore has an impact on the airflow through the cylinder 12. It is believed that the shape of the belt cover 76 can add to or detract from the efficiency of the fan 10. In this regard, the belt cover 76 is preferably shaped such that it tapers toward the portions of the cover 76 located furthest upstream and furthest downstream relative the direction of airflow. As shown in FIG. 6, the illustrated cover 76 has a tubular configuration having a teardrop shaped horizontal cross-section. The cover 76 includes a tubular nose section 76*a* and a tubular tail section 76*b*. The tubular nose section 76*a* is semi-circle shaped that tapers towards an end furthest upstream. This upstream end is generally located above, but lying along, the rotational axis $A_R$. The tubular tail section 76*b* is more triangular shaped than the nose section 76*a* and tapers towards a pointed end furthest downstream. This downstream end is generally located above, but lying along, the rotational axis $A_R$. It is believed this teardrop shape for the belt cover 76, having tapering end sections, facilitates maximizing the efficiency of the fan 10.

As indicated above, components of the drive assembly 16 function to support the drive assembly 16 and the propeller 14 in the cylinder 12 to eliminate the need for additional, undesirable support structure that may further obstruct the airflow through the cylinder 12. Particularly, in the illustrated fan 10, the propeller 14, the shaft 66, the bearings 78 and 80, and the bearing cover 72 are supported in the cylinder 12 by only the belt cover 76 but are otherwise unsupported in the cylinder 12. Those skilled in the art will appreciate that the belt 100 provides no appreciable support for the shaft 66. In this regard, other than the belt cover 76, the interior circumferential surface 18 of the cylinder 12, when viewed from the end 22 as in FIG. 4, is devoid of radially or chordally spanning support structure. That is to say, at least three quadrants of the interior surface 18, or 270 degrees of rotation around the rotational axis $A_R$, are devoid of support structure attached thereto. As previously discussed, the propeller diameter $\phi$ of the illustrated fan 10 is eighteen inches. For propeller diameters of about twenty inches or less, the interior surface of the cylinder being devoid of additional support structure is preferred. However, it is within the ambit of the present invention to utilize various alternative configurations for supporting the propeller and the drive assembly in the cylinder, particularly in fans having relatively larger propeller diameters. For example, if the propeller diameter is twenty-one inches or greater, some chordally or diametrically spanning support structure is preferred. However, any such additional structure should be minimized as much as possible.

One such example of a fan having additional support structure to support the propeller and drive assembly is the fan 210 illustrated in FIGS. 10 and 11. The fan 210 is similar to the fan 10 previously described in detail and includes a cylinder 212, a propeller 214 rotatably supported in the cylinder 212, and a drive assembly 216 operable to rotate the propeller 214. Because the fan 210 is similar to the fan 10 discussed above, like components of the fan 210 will not be described in detail with the understanding that they include similar structure and perform similar functions, however, they will be referenced with similar 200 series reference numerals (e.g., component 72 of the fan 10 is the bearing cover and the like component of the fan 210 will be referenced as bearing cover 272). However, unlike the fan 10, the fan 210 includes support structure to support the propeller 214, the shaft 266, the bearings 278 and 280, and the bearing cover 272 in the cylinder 212 in addition to the support provided by belt cover 276.

In particular, the fan 210 includes support plates 212*a* and 212*b* that are each fixed at one end to the top plate 274 of the bearing cover 272 and fixed at the other end to the interior circumferential surface 218 of the cylinder 212. Each of the support plates 212*a* and 212*b* present a substantially equivalent plate width $W_P$ extending along the interior circumferential surface 218 of the cylinder 212 and being generally parallel with the rotational axis of the propeller 214. The plate width $W_P$ preferably is minimized as much as possible but still provides sufficient support. In this regard, the cylinder 212 presents an axial length extending between the ends 220 and 222. For example, the illustrated fan 210 has a preferred propeller diameter of twenty-one inches and a preferred axial length of about twenty-one inches. The corresponding preferred plate width $W_P$ is less than about one-seventh of the axial length, i.e., less than about three inches. The illustrated plates 212*a* and 212*b* have a plate width $W_P$ of about 2.5 inches. It is further believed that the plate width should be at least one-tenth of the axial length to provide the desired support function. Accordingly, a fan having a propeller diameter of sixty inches and a preferred axial length of fifty-one inches, preferably includes support plates having a width of between about 5.1 and 7.3 inches. In addition to minimizing the width of the support plates, it is further believed that positioning the plates as far upstream from the propeller as possible facilitates minimizing any obstruction of airflow provided by the plates. In this regard, the support plates 212*a* and 212*b* are positioned adjacent the open end 220 of the cylinder 212 while the propeller 214 is positioned adjacent the opposite open end 222 of the cylinder 212.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A fan comprising:

a central hub for rotation about a rotational axis; and a plurality of blades fixed relative to the hub to project radially therefrom, each of said blades presenting a root adjacent the hub and a tip spaced radially outward from the root, each of said tips being spaced from the rotational axis a tip radius, each of said blades presenting a chord length that is smaller at the root and tip relative to a maximum chord length location spaced between the root and tip, said chord length presented by each of said blades progressively and gradually increasing from the root to the maximum chord length location and progressively and gradually increasing from the tip to the maximum chord length location, each of said blades presenting a stagger angle that is relatively greater at the tip than at the root, said stagger angle presented by each of said blades progressively and gradually increasing from the root to the tip, each of said blades presenting a camber height that is smaller at the root and tip relative to a maximum camber height location spaced between the root and tip, said camber height presented by each of said blades progressively and gradually increasing from the root to the maximum camber height location and progressively and gradually increasing from the tip to the maximum camber height location.

2. The fan as claimed in claim 1, each of said tips being spaced from the rotational axis about the same distance so that said tip radii are about equivalent.

3. The fan as claimed in claim 2, said hub presenting a generally solid radially-extending surface defining a generally uniform hub radius, said hub radius being about one-third the tip radius.

4. The fan as claimed in claim 1, said maximum chord length location of each of said blades being spaced from the rotational axis at least about sixty-three percent but less than seventy percent of the corresponding tip radius.

5. The fan as claimed in claim 1, said stagger angle presented by each of said blades being at least about 40 degrees at the root and less than about 72 degrees at the tip.

6. The fan as claimed in claim 1, said camber height presented by each of said blades being at least about 1.7 percent of the corresponding tip radius but less than about 3.8 percent of the corresponding tip radius.

7. The fan as claimed in claim 6, said maximum camber height location of each of said blades being spaced from the rotational axis about seventy percent to seventy-eight percent of the corresponding tip radius.

8. The fan as claimed in claim 1; and a tubular propeller housing rotatably supporting the hub.

9. The fan as claimed in claim 8, said housing being generally cylindrical shaped, said hub being rotatably supported within the housing so that the housing encircles the blades.

10. The fan as claimed in claim 9; and a drive assembly supported on the housing and being operable to rotate the propeller.

11. A fan comprising:

a propeller housing; and a propeller rotatably supported in the housing for rotation about a rotational axis, said propeller including a central hub and a plurality of blades fixed relative to the hub to project radially from the hub, each of said blades including an external surface having a shape defined by the relative positioning of a plurality of coordinates contained in at least nine cross-sections of said external surface, said plurality of coordinates being defined on a three-dimensional grid having its origin on said rotational axis and including an X axis extending radially from the origin, a Y axis coplanar with the X axis and extending from the origin orthogonally to the X axis, and a Z axis coextensive with said rotational axis, said plurality of coordinates comprising the coordinates listed in TABLE 2 herein.

12. The fan as claimed in claims 11, said plurality of coordinates comprising the coordinates listed in TABLE 2 scaled up by a fixed percentage.

13. The fan as claimed in claim 11, said plurality of coordinates comprising the coordinates listed in TABLE 2 scaled down by a fixed percentage.

14. The fan as claimed in claim 11; and a tubular propeller housing rotatably supporting the hub.

15. The fan as claimed in claim 14; and a drive assembly supported on the housing and being operable to rotate the propeller.

16. The fan as claimed in claim 1, said stagger angle presented by each of said blades varying at least about 30 degrees from the root to the tip.

17. A fan comprising:

a central hub for rotation about a rotational axis; and a plurality of blades fixed relative to the hub to project radially therefrom, each of said blades presenting a root adjacent the hub and a tip spaced radially outward from the root, each of said tips being spaced from the rotational axis a tip radius, each of said blades presenting a chord length that is smaller at the root and tip relative to a maximum chord length location spaced between the root and tip, said chord length presented by each of said blades progressively and gradually increasing from the root to the maximum chord length location and progressively and gradually increasing from the tip to the maximum chord length location, each of said blades presenting a stagger angle that is relatively greater at the tip than at the root, said stagger angle presented by each of said blades progressively and gradually increasing from the root to the tip, each of said blades presenting a camber height that is smaller at the root and tip relative to a maximum camber height location spaced between the root and tip, said camber height presented by each of said blades progressively and gradually increasing from the root to the maximum camber height location and progressively and gradually increasing from the tip to the maximum camber height location, said chord length presented by each of said blades being at least about thirty-eight percent of the corresponding tip radius but less than about forty-two percent of the corresponding tip radius.

18. A fan comprising:

a central hub for rotation about a rotational axis; and a plurality of blades fixed relative to the hub to project radially therefrom, each of said blades presenting a root adjacent the hub and a tip spaced radially outward from the root, each of said tips being spaced from the rotational axis a tip radius, each of said blades presenting a chord length that is smaller at the root and tip relative to a maximum chord length location spaced between the root and tip, said chord length presented by each of said blades progressively and gradually increasing from the root to the maximum chord length location and progressively and gradually increasing from the tip to the maximum chord length location, each of said blades presenting a stagger angle that is relatively greater at the tip than at the root, said stagger angle presented by each of said blades progressively and gradually increasing from the root to the tip, each of said blades presenting a camber height that is smaller at the root and tip relative to a maximum camber height location spaced between the root and tip, said camber height presented by each of said blades progressively and gradually increasing from the root to the maximum camber height location and progressively and gradually increasing from the tip to the maximum camber height location, each of said blades including an external surface having a shape defined by the relative positioning of a plurality of coordinates contained in at least nine cross-sections of said external surface, said plurality of coordinates being defined on a three-dimensional grid having its origin on said rotational axis, said plurality of coordinates comprising the coordinates listed in TABLE 2.

19. A fan comprising:

a central hub for rotation about a rotational axis; and a plurality of blades fixed relative to the hub to project radially therefrom, each of said blades presenting a root adjacent the hub and a tip spaced radially outward from the root, each of said tips being spaced from the rotational axis a tip radius, each of said blades presenting a chord length that is smaller at the root and tip relative to a maximum chord length location spaced between the root and tip, said chord length presented by each of said blades progressively and gradually increasing from the root to the maximum chord length location and progressively and gradually increasing from the tip to the maximum chord length location, each of said blades presenting a stagger angle that is relatively greater at the tip than at the root, said stagger angle presented by each of said blades progressively and gradually increasing from the root to the tip, each of said blades presenting a camber height that is smaller at the root and tip relative to a maximum camber height location spaced between the root and tip, said camber height presented by each of said blades progressively and gradually increasing from the root to the maximum camber height location and progressively and gradually increasing from the tip to the maximum camber height location, each of said blades including an external surface having a shape defined by the relative positioning of a plurality of coordinates contained in at least nine cross-sections of said external surface, said plurality of coordinates being defined on a three-dimensional grid having its origin on said rotational axis, said plurality of coordinates comprising the coordinates listed in TABLE 2 scaled up by a fixed percentage.

20. A fan comprising:

a central hub for rotation about a rotational axis; and a plurality of blades fixed relative to the hub to project radially therefrom, each of said blades presenting a root adjacent the hub and a tip spaced radially outward from the root, each of said tips being spaced from the rotational axis a tip radius, each of said blades presenting a chord length that is smaller at the root and tip relative to a maximum chord length location spaced between the root and tip, said chord length presented by each of said blades progressively and gradually increasing from the root to the maximum chord length location and progressively and gradually increasing from the tip to the maximum chord length location, each of said blades presenting a stagger angle that is relatively greater at the tip than at the root, said stagger angle presented by each of said blades progressively and gradually increasing from the root to the tip, each of said blades presenting a camber height that is smaller at the root and tip relative to a maximum camber height location spaced between the root and tip, said camber height presented by each of said blades progressively and gradually increasing from the root to the maximum camber height location and progressively and gradually increasing from the tip to the maximum camber height location, each of said blades including an external surface having a shape defined by the relative positioning of a plurality of coordinates contained in at least nine cross-sections of said external surface, said plurality of coordinates being defined on a three-dimensional grid having its origin on said rotational axis, said plurality of coordinates comprising the coordinates listed in TABLE 2 scaled down by a fixed percentage.

* * * * *